US009783970B2

(12) United States Patent
Shinohara et al.

(10) Patent No.: US 9,783,970 B2
(45) Date of Patent: Oct. 10, 2017

(54) DISCHARGE VALVE APPARATUS, FLUSH WATER TANK APPARATUS COMPRISING THIS DISCHARGE VALVE APPARATUS, AND FLUSH TOILET COMPRISING THIS FLUSH WATER TANK APPARATUS

(71) Applicant: TOTO LTD., Kitakyushu-shi, Fukuoka (JP)

(72) Inventors: Koki Shinohara, Kitakyushu (JP); Hideki Tanimoto, Kitakyushu (JP); Yukinori Kubozono, Kitakyushu (JP)

(73) Assignee: TOTO LTD., Fukuoka (JP)

( * ) Notice: Subject to any disclaimer, the term of this patent is extended or adjusted under 35 U.S.C. 154(b) by 31 days.

(21) Appl. No.: 15/077,040

(22) Filed: Mar. 22, 2016

(65) Prior Publication Data

US 2016/0281342 A1 Sep. 29, 2016

(30) Foreign Application Priority Data

Mar. 24, 2015 (JP) ..... 2015-060983

(51) Int. Cl.

| | |
|---|---|
| ***A61J 19/00*** | (2006.01) |
| ***E03D 1/14*** | (2006.01) |
| ***E03D 1/33*** | (2006.01) |
| ***E03D 1/34*** | (2006.01) |

(52) U.S. Cl.

CPC ..... *E03D 1/144* (2013.01); *E03D 1/33* (2013.01); *E03D 1/34* (2013.01)

(58) Field of Classification Search

CPC ..... E03D 1/33; E03D 1/144
USPC ..... 4/381
See application file for complete search history.

(56) References Cited

U.S. PATENT DOCUMENTS 5,742,951 A * 4/1998 Wright ..... E03D 1/00 4/331
6,640,351 B1 * 11/2003 Diaz-Perez ..... E03D 1/144 4/324
2008/0313797 A1 * 12/2008 Mahler ..... E03D 1/144 4/394

FOREIGN PATENT DOCUMENTS

JP 2013-100668 A 5/2013

* cited by examiner

*Primary Examiner* — Huyen Le
(74) *Attorney, Agent, or Firm* — Studebaker & Brackett PC

(57) ABSTRACT

Problem: To provide a discharge valve apparatus able to be disposed on a flush toilet with a relatively low silhouette by shortening the length of the valve body main shaft and lowering the height of the discharge valve apparatus.
Solution Means: A discharge valve apparatus having: a small-flush float mechanism and a large-flush float mechanism; wherein the valve body main shaft includes a single shared projecting portion which locks to the large-flush cam lock portion when the required amount of pull-up for the large-flush mode has been pulled up, and locks to the small-flush cam lock portion when the amount of pull-up required for the small-flush mode has been pulled up.

7 Claims, 14 Drawing Sheets

DISCHARGE VALVE APPARATUS, FLUSH WATER TANK APPARATUS COMPRISING THIS DISCHARGE VALVE APPARATUS, AND FLUSH TOILET COMPRISING THIS FLUSH WATER TANK APPARATUS

TECHNICAL FIELD

The present invention pertains to a discharge valve apparatus, a flush water tank apparatus comprising this discharge valve apparatus, a flush toilet comprising this flush toilet apparatus, and more particularly to a discharge valve apparatus for a flush water tank for storing flush water for flushing a toilet, a flush water tank comprising this discharge valve apparatus, and a flush toilet comprising this flush water tank apparatus.

BACKGROUND ART

For some time, direct drive discharge valve apparatuses have been known in which a valve body physically linked to an operating lever is pulled up from a valve seat on a discharge port in direct response to a pulling action by the pulling up of an operating lever by which a user starts a flush, thereby releasing the discharge port.

In order to implement different flush modes using two differing amounts of flush water, being a large-flush mode and a small-flush mode, such direct drive discharge valve apparatuses, as shown in Patent Document 1 (Japanese Published Unexamined Patent Application 2013-100668), comprise: a large-flush float, disposed at a relatively low position within a flush water tank to start a valve closing action in the large-flush mode; a large-flush cam member, connected to a large-flush float and capable of locking with a large-flush projecting portion on a valve body main shaft; a small-flush float disposed at a position higher than the large-flush float, for starting the valve closing action in the small-flush mode; and a small-flush cam member, connected to the small-flush float disposed at a relatively high position, and itself disposed above the large-flush cam member and capable of locking with the small-flush projecting portion of the valve body main shaft. On the valve body main shaft of such a discharge valve apparatus, two projecting portions are disposed, being a large-flush projecting portion locking with a large-flush cam member, and a small-flush projecting portion, placed at a position higher than the large-flush projecting portion and locking with a small-flush cam member.

In this type of direct drive discharge valve apparatus, the upper small-flush cam member and the small-flush projecting portion are locked in response to a small degree of pulling up of the valve body main shaft when in the small-flush mode; thereafter these locks are released and a valve closing action started when the small-flush float drops. Also, the lower large-flush cam member and the large-flush projecting portion are locked in response to a large degree of pulling up of the valve body main shaft when in the large-flush mode; thereafter these locks are released and a valve closing action started when the large-flush float drops.

SUMMARY OF INVENTION

Technical Problem

However, in the discharge valve apparatus described in Patent Document 1, the problem arose that due to separate disposition of the large-flush projecting portion and the small-flush projecting portion of the valve body main shaft, the length of the valve body main shaft became elongated.

Also, the small-flush float, which corresponds to a drop in the water level of a small-flush water amount, was disposed at a position higher than the large-flush float, therefore the small-flush projecting portion for locking with the small-flush cam member extending from the small-flush float was also disposed at a position above the large-flush projecting portion. This led to the problem that the valve body main shaft became elongated (raising the height) by the amount needed to dispose the small-flush projecting portion.

This lengthening of the valve body main shaft caused the height of the discharge valve apparatus, which housed the valve body main shaft while enabling it to be pulled up, to rise, making it difficult to respond to the need for lower silhouette flush toilets.

The present invention was therefore undertaken to resolve problems and issues with the conventional art, and has the object of providing a discharge valve apparatus having only a single shared projecting portion for a small-flush cam lock portion and a large-flush cam lock portion, wherein the length of the valve body main shaft can be shortened and the height of the discharge valve apparatus lowered to enable placement on a relatively low silhouette toilet.

Solution to Problem

To accomplish the object above, the present invention is a discharge valve apparatus for flushing a toilet, comprising: a valve body comprising a valve body main shaft the valve body opening and closing a discharge port disposed on the bottom surface of a flush water tank; a small-flush float mechanism comprising a small-flush cam lock portion formed to be engageable with the valve body main shaft, and a small-flush float which is lowered with falling water level when a predetermined amount of small-flush water is discharged, the small-flush float mechanism being configured such that engagement of the small-flush cam lock portion with the valve body main shaft is released when the small-flush float is lowered; a large-flush float mechanism comprising a large-flush cam lock portion formed to be engageable with the valve body main shaft, and a large-flush float which is lowered with a falling water level when a predetermined amount of large-flush water is discharged, the large-flush float mechanism being configured such that engagement of the large-flush cam lock portion with the valve body main shaft is released when the large-flush float is lowered; and a casing portion for housing the valve body, the small-flush float and the large-flush float, the small-flush float and the large-flush float being disposed above the valve body; wherein the valve body main shaft of the valve body comprises a single shared projecting portion which engages with the large-flush cam lock portion when the valve body main shaft is pulled up by a pull-up height set for the large-flush mode, and engages with the small-flush cam lock portion when the valve body main shaft is pulled up by a pull-up height set for the small-flush mode.

In the invention thus constituted, when one shared projecting portion of the valve body main shaft is pulled up by the pull up height for the large-flush mode, it locks with the large-flush cam lock portion, and when pulled up by the pull up height for the small-flush mode, it locks with the small-flush cam locking portion; in both the large-flush mode and the small-flush mode, flush water is discharged to the toilet from the discharge port with the valve body lifted up. In the small-flush mode, when the water level in the flush water tank drops to the water level at which a specified small-flush water amount is discharged, the drop of the small-flush float in tandem with the water level causes the lock between the small-flush cam lock portion and the single shared projecting portion of the valve body main shaft to be released so that the valve body falls and the discharge port is closed. In the large-flush mode, when the water level in the flush water tank drops to the water level at which a specified large-flush water amount is discharged, the drop of the large-flush float together with the water level causes the lock between the large-flush cam lock portion and the single shared projecting portion of the valve body main shaft to be released so that the valve body falls and the discharge port is closed. Thus the small-flush mode and the large-flush mode can be performed using a single shared projecting portion of the valve body main shaft. Therefore since the valve body main shaft has only a single shared projecting portion for the small-flush cam lock portion and the large-flush cam lock portion, the length of the valve body main shaft can be shortened, the height of the discharge valve apparatus lowered, and a discharge valve apparatus disposable on a relatively low silhouette toilet can be provided.

In the present invention, preferably, the small-flush cam lock portion of the small-flush float mechanism is disposed at a lower position than the large-flush cam lock portion of the large-flush float mechanism.

In the invention thus constituted, the small-flush cam lock portion is disposed at a lower position than the large-flush cam lock portion. When lifted up to the height of the large-flush cam lock portion, the valve body main shaft single shared projecting portion can lock with the large-flush cam lock portion, and when lifted up to the height of the small-flush cam lock portion, disposed at a position lower than the height of the large-flush cam lock portion, can lock with the small-flush cam lock portion. Hence the small-flush cam lock portion is not disposed at a position higher than the large-flush cam lock portion as in the past. Thus the need can be eliminated for disposing a small-flush projecting portion of the valve body main shaft corresponding to the small-flush cam lock portion, disposed at a position higher than the large-flush cam lock portion as in the past. Therefore since the valve body main shaft has a single shared projecting portion locking with the small-flush cam lock portion disposed at a position below the large-flush cam lock portion, the length of the valve body main shaft can be shortened, the height of the discharge valve apparatus lowered, and a discharge valve apparatus disposable on a relatively low silhouette toilet can be provided.

In the present invention, preferably, the small-flush float mechanism further comprises a float hold shaft holding the small-flush float, and the small-flush cam lock portion is linked to the bottom end portion of the float hold shaft.

In the invention thus constituted, the small-flush cam lock portion is linked to the bottom end portion of the float hold shaft, and can therefore lock with the single shared projecting portion at a relatively low position. Therefore since the valve body main shaft has a single shared projecting portion at a relatively close position, the length of the valve body main shaft can be shortened, the height of the discharge valve apparatus lowered, and a discharge valve apparatus disposable on a relatively low silhouette toilet can be provided.

In the present invention, preferably, the casing portion further comprises a hold portion extended laterally from the side portion of the casing and slidably holding the float hold shaft.

In the invention thus constituted, the casing portion hold portion can be supported from the side with the float hold shaft in a slidable state, thus eliminating the need to provide a bottom portion hold portion for supporting the bottom end portion of the float hold shaft from the bottom portion of the casing as in the past. Hence the small-flush cam lock portion can be linked to the bottom end portion of the float hold shaft, and the small-flush cam lock portion can be disposed at a relatively low position.

In the present invention, preferably, the float hold shaft of the small-flush float mechanism forms a screw portion on the outer perimeter surface of the float hold shaft, the screw portion being threadedly connected to the small-flush float.

In the invention thus constituted, a screw portion threaded to the small-flush float is formed on the outer perimeter surface of the float hold shaft. Hence the height position of the small-flush float, which starts to drop in tandem with the water level in the flush water tank when the water level in the flush water tank drops to the water level for discharging a predetermined small-flush water amount, can be fine tuned along the screw portion of the float hold shaft. For this reason, the predetermined small-flush water amount discharged from the flush water tank can be fine tuned with relatively high precision without relying on a stepped adjustment as in the past, so that even when the flush water amount in the flush water tank is reduced due to the need for water conservation, for example, a predetermined small-flush water amount out of this reduced flush water volume can be adjusted with relatively high precision.

The present invention is a flush water tank apparatus comprising a discharge valve apparatus.

In the invention thus constituted, a flush water tank apparatus with a lower discharge valve apparatus height and having a relatively low silhouette can be provided.

The present invention is a flush toilet comprising a flush water tank apparatus.

In the invention thus constituted, a flush water toilet with a lower discharge valve apparatus height and having a relatively low silhouette can be provided.

Advantageous Effects of Invention

Using the discharge valve apparatus, flush water tank apparatus comprising this discharge valve apparatus, and flush toilet comprising this flush water tank apparatus of the present invention, the length of the valve body main shaft can be shortened and the height of the discharge valve apparatus lowered, allowing for placement on a toilet with a relatively low silhouette.

DESCRIPTION OF EMBODIMENTS

Below, referring to the attached drawings, we explain a flush toilet to which a discharge valve apparatus according to an embodiment of the invention has been applied.

Figure 1:
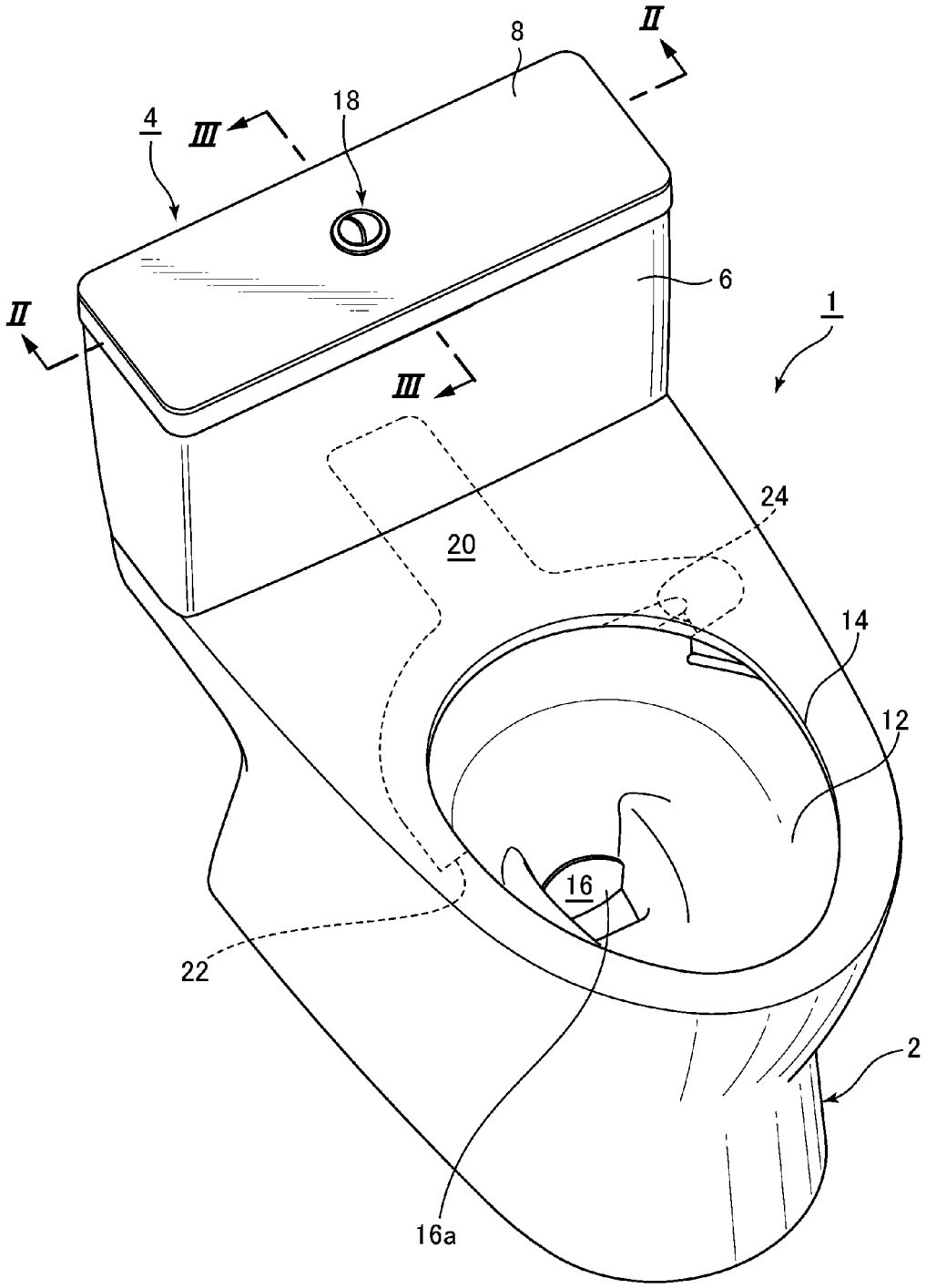
FIG. 1 is a summary perspective view of a flush toilet to which a discharge valve apparatus according to an embodiment of the invention is applied.
Figure 2:
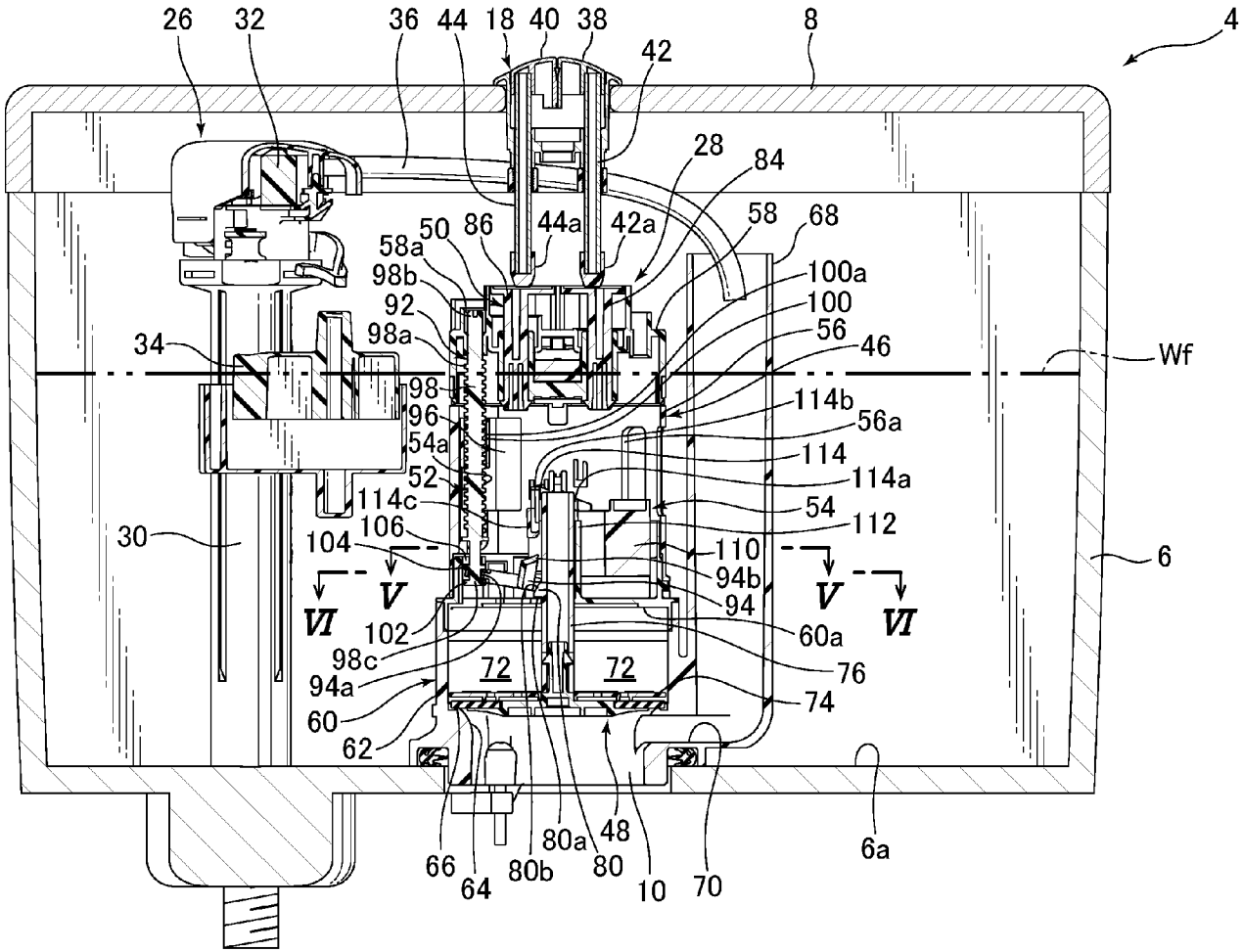
FIG. 2 is a cross section seen along line II-II in FIG. 1.
Figure 3:
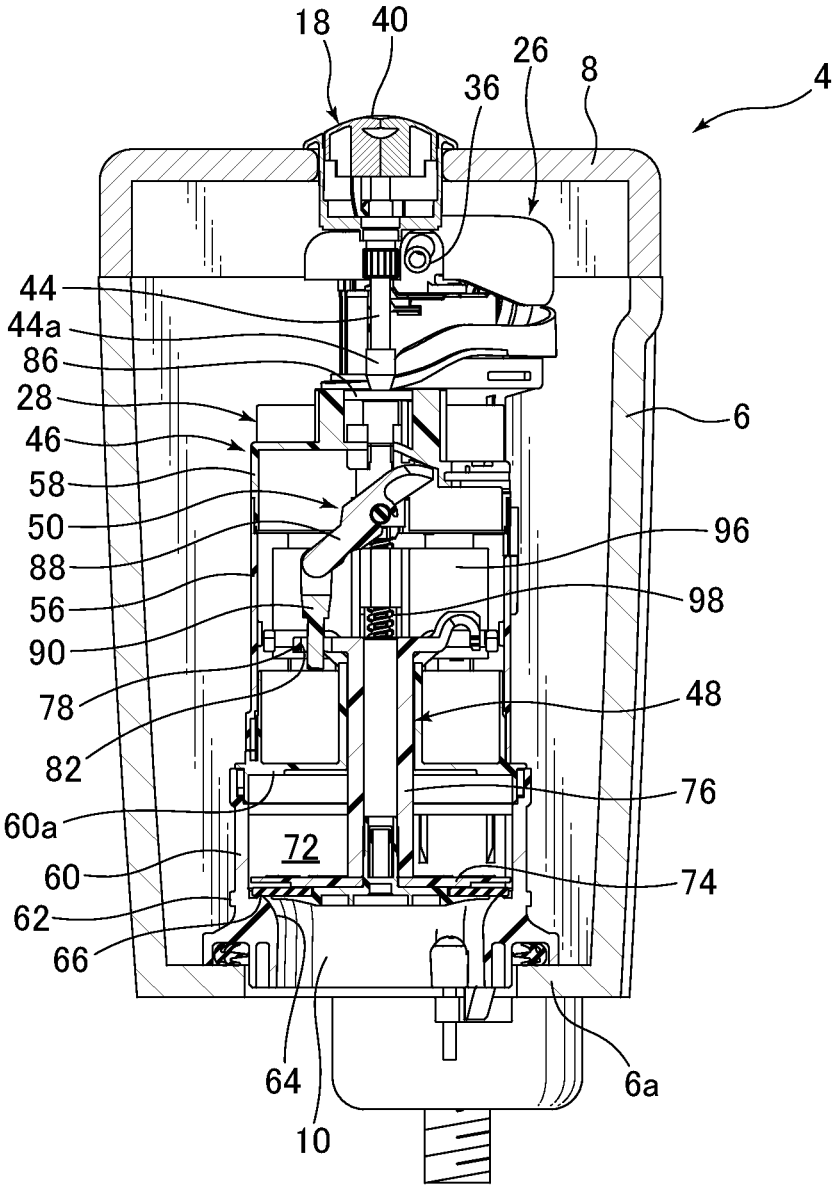
FIG. 3 is a cross section seen along line III-III in FIG. 1.

First, referring to FIGS. 1 through 3, we explain a discharge valve apparatus prior to mounting an operating apparatus, a flush water tank apparatus comprising this discharge valve apparatus, and a flush toilet comprising this flush water tank apparatus.

FIG. 1 is a summary perspective view of a flush toilet to which a discharge valve apparatus according to an embodiment of the invention is applied; FIG. 2 is a cross section seen along line II-II in FIG. 1; FIG. 3 is a cross section seen along line III-III in FIG. 1.

As shown in FIG. 1, a flush toilet 1 comprising a flush water tank apparatus to which the discharge valve apparatus according to a first embodiment of the invention is applied comprises a toilet main body 2 for receiving waste, and a cuboid flush water tank apparatus 4 disposed at the rear and above this toilet main body 2. The flush water tank apparatus 4 comprises a reservoir tank 6 for storing flush water for flushing a toilet. Also, a discharge opening 10 penetrating in the vertical direction is provided at the bottom portion 6*a* of this reservoir tank 6. Note that this embodiment of the invention may also be a flush toilet in which the flush water tank apparatus 4 and the toilet main body 2 are separately formed, or may be what is known as a one-piece flush toilet, in which the flush water tank apparatus 4 and the toilet main body 2 are integrally formed as a single piece.

A lid 8, removably affixed on the top edge of the reservoir tank 6, is placed on the peak portion of this flush water tank apparatus 4 so as to cover essentially all of the upper opening part of the reservoir tank 6.

A pushbutton type of manual operation apparatus 18, detailed below, is disposed on the top surface of this lid 8. When a user pushes the manual operating apparatus 18 pushbutton down, a predetermined flow volume of flush water is supplied from the flush water tank apparatus 4 to the toilet main body 2 according to flush type: either large-flush mode flush operation or small-flush mode flush operation.

The flush water tank apparatus 4 is a flush water tank in water conserving flush toilet able to provide flush water in the amount of 1.5 liters to 6 liters to the toilet main body 2, and preferably to supply and flush the toilet main body 2 with a flush water amount of 1.5 liters to 3.8 liters.

The toilet main body 2 of the flush toilet 1 comprises a bowl portion 12 placed on the front side thereof, and a rim portion 14 formed on the top edge of this bowl portion 12.

An entry 16*a* on a discharge trap conduit 16 is opened in the bottom portion of the toilet main body 2 bowl portion 12, and the discharge trap conduit 16 is connected from this entry 16*a* to an under-floor discharge pipe (not shown) through a discharge socket (not shown).

The flush toilet 1 according to the present embodiment may be what is known as a siphon-type toilet in which waste in the bowl portion 12 is suctioned and released all at once from the discharge trap conduit 16 using the siphon effect; but the flush toilet 1 is not limited to a siphon type of flush toilet, and may also be applied to other types of flush toilets, such as those known as wash-down flush toilets, in which waste is pushed out by the action of water flow resulting from a water drop in the bowl portion.

Next, the toilet main body 2 comprises a water conduit 20 into which flush water discharged from the discharge port 10 on the reservoir tank 6 flows, a first rim spout opening 22 formed near the left center as seen from the front of the rim portion 14, and a second rim spout opening 24 (see FIG. 1) formed on the right rear as seen from the front of the rim portion 14.

Also, the water conduit 20 forms a flow path extending from the rear center of the flush toilet 2 toward the front side, then branching and extending to either the first rim spout opening 22 or the second rim spout opening 24. Flush water discharged from the reservoir tank 6 discharge port 10 flows in the water conduit 20 from the rear center of the flush toilet 2 toward the front side, then branches and reaches the first rim spout opening 22 or the second rim spout opening 24. Flush water respectively spouted from the first rim spout opening 22 and the second rim spout opening 24 flushes the bowl portion 12 and discharges waste from the discharge trap conduit 16.

Next, using FIGS. 2 and 3, we explain the internal structure of a flush water tank in a flush toilet to which the discharge valve apparatus according to an embodiment of the invention has been applied.

As shown in FIGS. 2 and 3, the toilet main body portion 4 comprises: a water supply apparatus 26 for supplying flush water into the reservoir tank 6; a manual operation apparatus 18 which by a user's hand, etc. starts either a large-flush mode flush operation or a small-flush mode flush operation; and a discharge valve apparatus 28 for opening a discharge port 10 to flush water stored in a reservoir tank 6, allowing it to flow into the water conduit 20 on the flush toilet 2.

The water supply apparatus 26 comprises: a water supply pipe 30, connected to an external water supply source (not shown) and disposed to extend upward from the bottom portion of the reservoir tank 6; a water supply valve 32, attached to the top end portion of this water supply pipe 30, for switching between spouting and shutting off water into the interior of the reservoir tank 6 for flush water supplied from the water supply pipe 30; and a float 34 for moving up and down in response to fluctuations in the water level in reservoir tank 6, to switch between spouting and shutting off water.

Multiple spout ports (not shown) are formed on the bottom end portion of the outer perimeter side of the water supply pipe 30, and flush water which has passed through the water supply valve 32 is spouted into the reservoir tank 6 from these spout ports (not shown).

Also, in the water supply apparatus 26, when flush water in the reservoir tank 6 is discharged into the toilet, the flush water level drops and the float 34 falls, causing the water supply valve 32 to open and start spouting from the spout port, thereby starting spouting from a water source (not shown) outside the reservoir tank 6 into the reservoir tank 6. In addition, when spouting is continued and the water level in the reservoir tank 6 rises, the float 34 rises, resulting in closing of the water supply valve 32, shutting off water from being spouted from the spout port. By this means the flush water level inside the reservoir tank 6 is maintained at a predetermined full water level.

Note that the water supply apparatus 26, although not discussed in the present embodiment, comprises a refill 36; part of the flush water flowing out from this refill 36 flows into an overflow pipe and can be supplied into the bowl portion 12 as replenishment water through the water conduit 20 in the flush toilet 2.

The manual operation apparatus 18 is a pushbutton manual operation apparatus. The manual operation apparatus 18 comprises a large-flush button 38 for mechanically directing the start of a large-flush mode flush operation in the flush toilet 1; a small-flush button 40 for mechanically directing the start of a small-flush mode flush operation in the flush toilet 1; a large-flush rod member 42 affixed to the bottom side of the large-flush button 38 and extending downward; and a small-flush rod member 44 affixed to the bottom side of the small-flush button 40 and extending downward.

When a user performs the operation of pushing the large-flush button 38, the large-flush rod member 42 is pushed down together with the large-flush button 38, and the tip portion 42*a* of the large-flush rod member 42 pushes down the discharge valve apparatus large-flush operating portion 84 described below.

When a user performs the operation of pushing the small-flush button 40, the small-flush rod member 44 is pushed down together with the small-flush button 40, and the tip portion 44*a* of the small-flush rod member 44 pushes down the discharge valve apparatus small-flush operating portion 86 described below.

By pushing the large-flush button 38 or the small-flush button 40, a user can drive the discharge valve apparatus 28 in response to either a large-flush mode flush operation or a small-flush mode flush operation.

Note that in the embodiment of the invention we explained the manual operation apparatus 18 with the example of a valve body pull up mechanism in which the valve body can be pulled up by manually pushing down the large-flush button 38 or the small-flush button 40, but the manual operation apparatus 18 can also be formed using a valve body pull up mechanism in which a wire take-up apparatus is operated by manually rotating an operating handle on an operating handle apparatus, so that a valve body pull up operation can be achieved by pulling up (winding) the operating wire. Also, the manual operation apparatus 18 can be changed to a powered wire take-up apparatus to enable a valve body pull up operation by powered pulling up (winding) of an operating apparatus.

Next we explain the discharge valve apparatus 28 in more detail using FIGS. 2 through 7.

Figure 4:
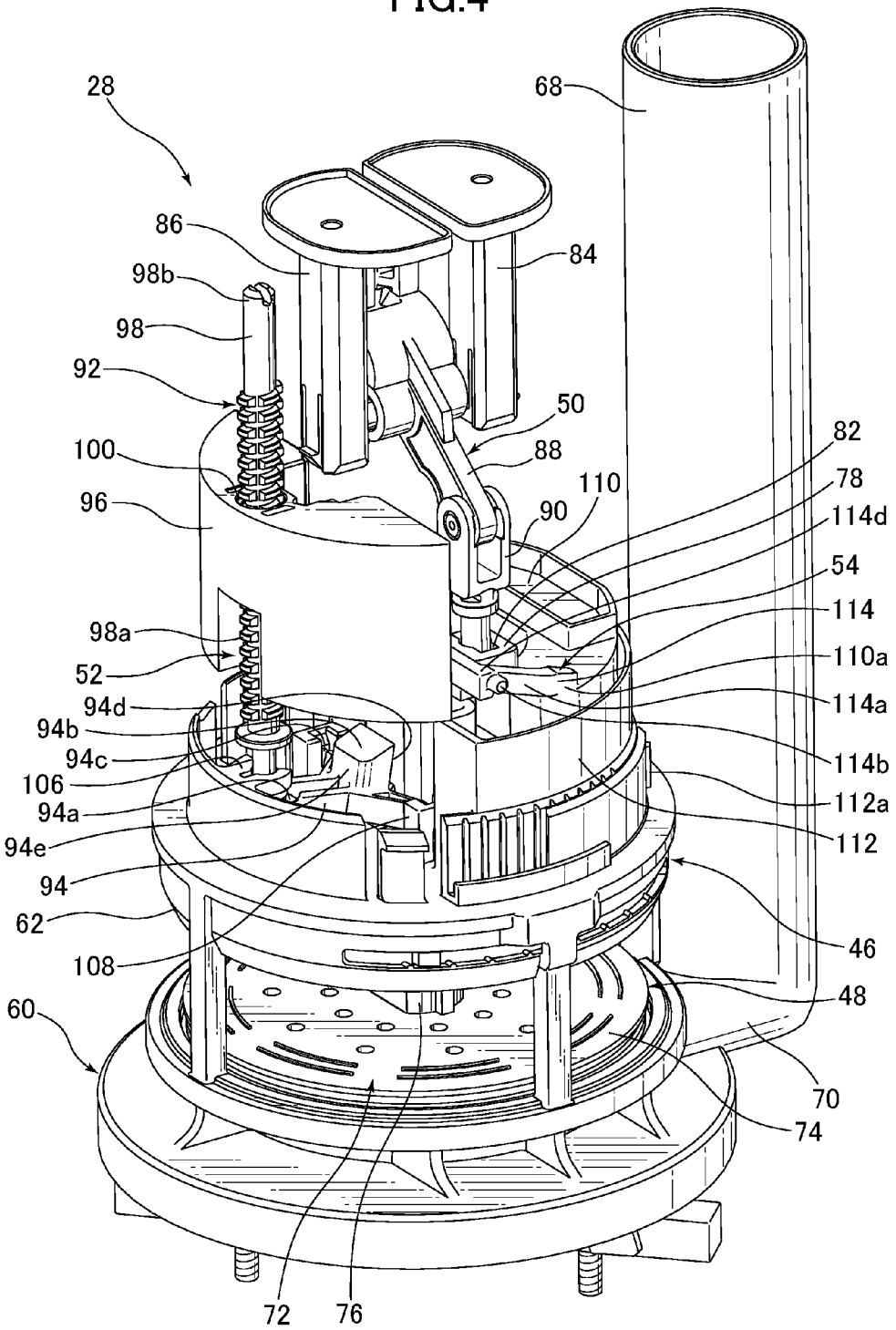
FIG. 4 is a summary perspective view of the internal structure of a discharge valve apparatus according to an embodiment of the invention with the casing lid portion and body portion removed.
Figure 5:
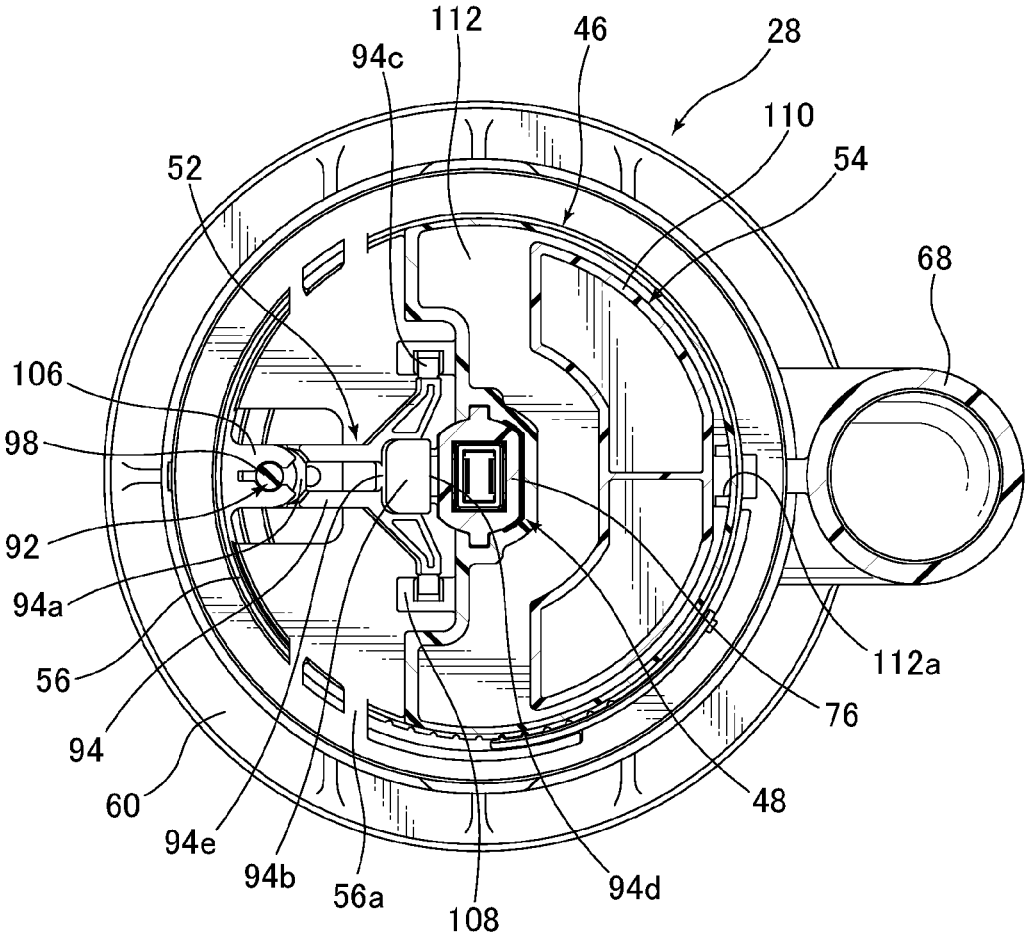
FIG. 5 is a cross section seen along line V-V in FIG. 2.
Figure 6:
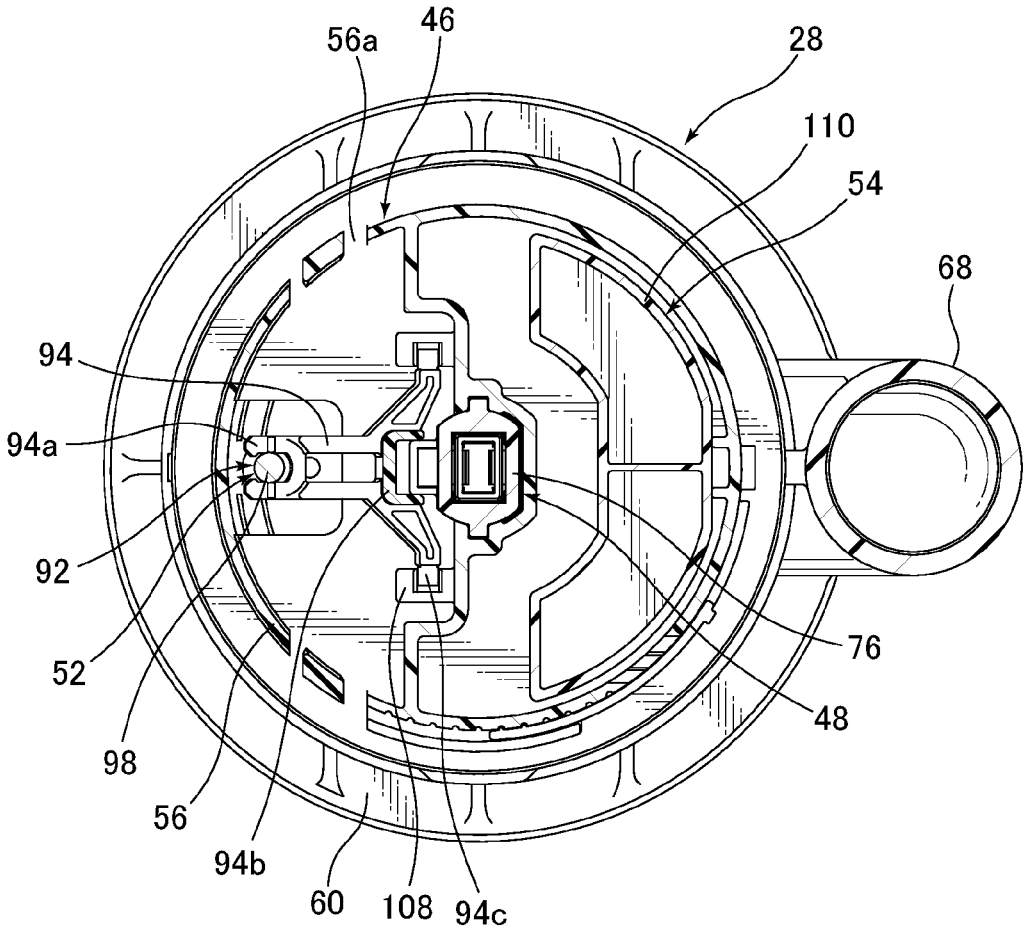
FIG. 6 is a cross section seen along line VI-VI in FIG. 2.
Figure 7:
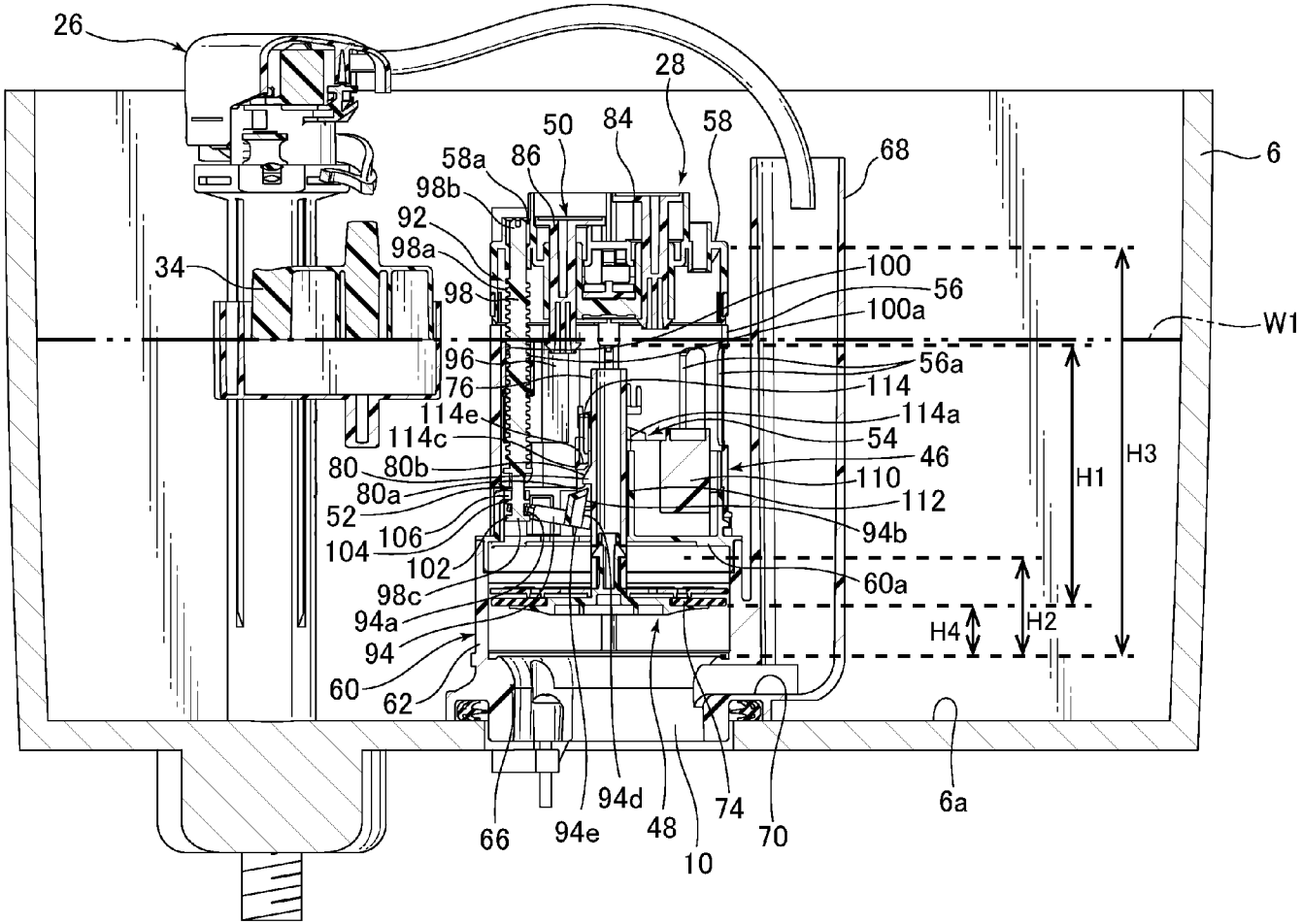
FIG. 7 is a partial cross section seen along line II-II in FIG. 1, showing the state immediately after the valve body has been raised to start the small-flush mode in a discharge valve apparatus according to an embodiment of the invention.

FIG. 4 is a summary perspective view of the internal structure of a discharge valve apparatus according to an embodiment of the invention with the casing lid portion and body portion removed; FIG. 5 is a cross section seen along line V-V in FIG. 2; FIG. 6 is a cross section seen along line VI-VI in FIG. 2; FIG. 7 is a partial cross section seen along line II-II in FIG. 1, showing the state immediately after the valve body has been raised to start the small-flush mode in a discharge valve apparatus according to an embodiment of the invention.

The discharge valve apparatus 28 has a casing 46 forming the external appearance of the discharge valve apparatus 28, a valve body portion 48 for opening and closing the discharge port 10 disposed on the bottom surface of the reservoir tank 6, a pull-up mechanism 50 capable of pulling the valve body portion 48 upward in response to an operation outside the casing 46, a small-flush float mechanism 52 made of resin for starting the valve closing action in the small-flush mode, and a large-flush float mechanism 54 made of resin for starting the valve closing action in the large-flush mode.

The casing 46 is formed in a cylindrical shape forming the external appearance of the discharge valve apparatus 28, and houses within it the valve body portion 48, and the small-flush float mechanism 52 and large-flush float mechanism 54 disposed above the valve body portion 48, and is formed to cover the side and tops of these elements.

The casing 46 comprises a cylindrical body portion 56 forming the side portion perimeter surface of the casing 46, a generally circular lid portion 58 formed to generally cover the opening part at the peak portion of this body portion 56, and a discharge port portion 60 attached to the discharge port 10 on the reservoir tank 6.

The lid portion 58 is affixed relatively solidly to the body portion 56 by locking with tabs or the like. Note that in the casing 46, the trunk portion 56 and the lid portion 58 may also be formed from the beginning as a single piece, rather than as separate pieces. Multiple vertically elongated slits 56*a* through which flush water can pass are formed in the side perimeter surface of the body portion 56.

The discharge port portion 60 comprises a generally cylindrical discharge port portion main body 62 attached to the discharge port 10 on the reservoir tank 6; a reduced diameter portion 64 positioned inside this discharge port portion main body 62, for reducing the diameter in the downward direction, and a valve seat 66 formed in a generally annular shape along the top edge of this reduced diameter portion 64, and projecting upward.

In addition, the discharge port portion 60 comprises an overflow pipe connecting portion 70 which integrally connects and communicates between the lower part of the overflow pipe 68 and the discharge port portion main body 62. If flush water in the reservoir tank 6 exceeds a specified height corresponding to the top end position of the overflow pipe 68, the overflow pipe 68 causes outflow to the discharge valve apparatus 28.

In addition, multiple connecting ports 72 are formed in the perimeter direction of the region above the valve seat 66 on the discharge port 10, as shown in FIGS. 2 through 4, and the opening cross section of each communication port 72 is formed to be rectangular as seen in front elevation. These connecting ports 72, as shown in FIG. 4, are able to effect communication between the reservoir tank 6 interior and the discharge port portion main body 62 interior, and allow flush water in the reservoir tank 6 to flow into the discharge port 10.

The valve body portion 48, as shown in FIGS. 2 through 4, comprises: a disk-shaped valve body 74 for opening and closing the discharge port 10 by contacting (seating) on the valve seat 66 on the discharge port portion 60, a columnar valve body main shaft 76 extending upward from the center of the valve body 74, and a planar attaching portion 78 extending essentially laterally from the top portion of this valve body main shaft 76.

The valve body portion 48 is arranged so that the valve body 74 for opening and closing the discharge port 10, disposed on the bottom portion 6*a* of the reservoir tank 6, is pulled up in response to the pulling up of this valve body main shaft 76. The valve body 74 can be moved up and down inside the discharge port portion 60. The valve body 74 is seated on the valve seat 66 at the furthest dropped position, and is positioned close to the peak portion 60*a* of the discharge port portion 60 at the furthest raised position.

On the valve body portion 48 valve body main shaft 76, the valve body 74 is connected on the bottom end thereof, while the top end is connected to the planar attaching portion 78, which communicates with the pull-up mechanism 50 operated by the large-flush button 38 and the small-flush button 40.

Close to its center in the up-down direction, the valve body main shaft 76 of the valve body portion 48 comprises a single shared projecting portion 80, which locks with a large-flush cam lock portion 114, described below, when pulled up to a height equal to or greater than the large-flush mode pull-up amount (pull-up height) H2, and locks with a small-flush cam lock portion 94 when pulled up to a height equal to or greater than a small-flush mode pull-up amount (pull-up height) H4. Because the valve body main shaft 76 comprises a single shared projecting portion 80, the position at which the single shared projecting portion 80 locks with the small-flush cam lock portion 94 is lower than the position at which it locks with the large-flush cam lock portion 114, as described below. Hence it is sufficient for the valve body main shaft 76 to have at least a length extending to the height of the single shared projecting portion 80, which locks with the large-flush cam lock portion 114.

The single shared projecting portion 80 is formed to project from the valve body main shaft 76 outward and toward the small-flush side float mechanism side, described below. Shown in cross section, in the single shared projecting portion 80 bottom side 80*a* is formed horizontally, and top side 80*b* forms an outwardly oriented downward sloping triangle. The raised bottom side 80*a*, which projects outward, forms a tab portion, which upon dropping locks so as to catch on the locking raised portion 94*b*, described below. The bottom side 80*a* forms a tab portion and locks on the locking indented portion, described below, so as to catch on it.

Because the top side 80*b* forms a surface sloping toward the outside, when the valve body portion 48 is pulled up, it can be pulled up to a position above these members, without the top side 80*b* locking with the locking raised portion 94*b* and/or the locking indented portion 114*c*.

On the planar attaching portion 78, an attaching hole 82 is formed close to the center of a predetermined width on a cuboid flat plate extending to the side from the valve body main shaft 76. The attaching hole 82 is formed as an opening in which both the top and bottom sides at the center of a square opening widen in a raised shape toward the outside.

The pull-up mechanism 50 comprises: a large-flush operating portion 84, able to slide in the up-down direction and disposed so that its top surface is exposed to the peak surface of the lid portion 58 on the casing 46; a small-flush operating portion 86, able to slide in the up-down direction and disposed so that its top surface is exposed to the peak surface of the lid portion 58; a first rotation link 88, which rotates about a rotational axis starting from a standby state when the large-flush operating portion 84 or the small-flush operating portion 86 is pushed downward; and a second link 90, rotatably attached at its own top end to one end of the first rotation link 88, itself moving upward in response to the amount of rotation of the first rotation link 88.

The first rotation link 88 is rotated up to a relatively large rotation amount in response to the relatively large amount of pushing movement of the large-flush operating portion 84. The first rotation link 88 is rotated up to a relatively small rotation amount in response to the relatively small amount of movement from pushing in the small-flush operating portion 86.

After insertion into the attaching hole 82 on the planar attaching portion 78, disposition of the bottom end portion of the second link 90 at a changed orientation causes locking with the bottom surface of the planar attaching portion 78 when the second link 90 rises, so that the entire planar attaching portion 78 and the valve body portion 48 can be pulled up.

Therefore in a standby state in which the large-flush operating portion 84 and the small-flush operating portion 86 are not pushed down, the first rotation link 88 is in a standby state; the bottom end portion of the second link 90, which is linked with the first rotation link 88, is not locked with the planar attaching portion 78, and the valve body portion 48 closes off the discharge port 10.

Next, if a user pushes down the large-flush button 38 and the large-flush operating portion 84 is pushed in to start a large-flush mode flushing operation, the first rotation link 88 is rotated by a relatively large rotation amount, and the second link 90 is pulled upward by a relatively large motion amount. Therefore the bottom end portion of the second link 90 pulls up the planar attaching portion 78 to a relatively large movement amount H2, and the valve body portion 48 opens the discharge port 10, starting a large-flush mode flush operation.

Next, if a user pushes down the small-flush button 40 and the small-flush operating portion 86 is pushed in to start a small-flush mode flushing operation, the first rotation link 88 is rotated by a relatively small rotation amount, and the second link 90 is pulled upward by a relatively small motion amount. Therefore the bottom end portion of the second link 90 pulls up the planar attaching portion 78 to a relatively small movement amount H4, and the valve body portion 48 opens the discharge port 10, starting a small-flush mode flush operation.

The small-flush float mechanism 52 comprises: a small-flush float portion 92, which drops together with the water level in the reservoir tank 6 when the water level in the reservoir tank 6 drops to the water level at which a predetermined small-flush water volume is discharged, and a small-flush cam lock portion 94 formed to be lockable to the valve body main shaft 76; and is formed so that the lock between the small-flush cam lock portion 94 and the valve body main shaft 76 is released by the drop of the small-flush float portion 92.

The small-flush float portion 92 comprises a small-flush float 96 which, due to the buoyancy effect of water, is raised in response to the rise of the water level in the reservoir tank 6 and falls with the drop in water level in the reservoir tank 6; and a float hold shaft 98 extending up and down and supporting the small-flush float 96.

The small-flush float 96 is a columnar member of which the horizontal cross sectional shape is generally a semicircle carved out at the center, having a predetermined height. Close to the outer perimeter side of the small-flush float 96, a generally round through-hole 100 for inserting the float hold shaft 98 extends in the vertical direction. The small-flush float 96 is formed of a member which floats under the buoyancy effect of water. A female screw thread 100*a* is formed on the inside surface of this through-hole 100.

The small-flush float 96 is attached at the middle part in the axial direction (up-down direction) of the float hold shaft 98, and the attachment position of the small-flush float 96 to the float hold shaft 98 can be changed in the axial direction.

The float hold shaft 98 is a generally round bar-shaped member, on which a male screw thread 98*a* is formed on the outer perimeter surface, except for the top and bottom end portions. The float hold shaft 98 is disposed to extend generally parallel to the valve body main shaft 76, and in the vertical direction. The float hold shaft 98 male screw thread 98*a* and the small-flush float 96 female screw thread 100*a* are formed to mutually engage. Hence a screw portion is formed by the float hold shaft 98 male screw thread 98*a* and the small-flush float 96 female screw thread 100*a*. By rotating the float hold shaft 98 relative to the small-flush float 96, the height of the small-flush float 96 relative to the float hold shaft 98 (i.e., the height of the small-flush float 96 inside the discharge valve apparatus 28) can be very finely adjusted. By this screw-type adjustment, the height of the small-flush float 96 can be fine tuned in a stepless manner. Therefore the height of the small-flush float 96 can be fine tuned, and the discharge volume (toilet flush volume) from the reservoir tank 6 in the small-flush mode determined by the height of the small-flush float 96 can be specified with high precision. For example, even in cases where the volume of flush water stored in the reservoir tank 6 is relatively small due to the demand in recent years for water conservation, the small-flush water amount required from the reservoir tank 6 for toilet flushing can be supplied with high precision.

A round bottom end flange 102 with a diameter larger than the float hold shaft 98 is formed at the bottom end of the float hold shaft 98; in addition, a lower portion top flange 104 with a diameter approximately the same size as the bottom end flange 102 is formed on the float hold shaft 98, above the bottom end flange 102 and below the female screw thread 100*a*.

The casing 46 comprises: a hold shaft attaching hole portion 58*a* on the lid portion 58 of the casing 46 into which the float hold shaft 98 top end portion 98*b* is inserted, and a side hold portion 106 for supporting the float hold shaft 98 in a slidable state from the side.

The hold shaft attaching hole portion 58*a* is opened in the vertical downward direction, and is formed to accept the top end portion 98*b* on the float hold shaft 98. The hold shaft attaching hole portion 58*a* supports so that the float hold shaft 98 can slide only in the up-down direction.

The side hold portion 106 extends laterally inward from the inside surface of the side wall of casing 46. The side hold portion 106 is formed in a C shape, open toward the inside, and is disposed so as to sandwich the float hold shaft 98 between two separated horizontal support arms. The side hold portion 106 supports the float hold shaft 98 so that it can slide only in the up-down direction. The side hold portion 106 can support the float hold shaft 98 from the side at a position above the bottom end portion 98*c* of the float hold shaft 98, thereby enabling the attachment of the small-flush cam lock portion 94 close to the bottom end of the float hold shaft 98.

The float hold shaft 98 bottom end portion 98*c* is not supported by a conventional hold portion rising from the bottom upward, and can therefore be positioned in a region closer to the peak portion 60*a* of the lower discharge port portion 60 than in the past. Hence the small-flush cam lock portion 94 can be disposed at a position lower than the large-flush cam lock portion 114 and at a relatively low position close to the peak portion 60*a* of the discharge port portion 60. Since the bottom end of the float hold shaft in this way conventionally required support by a conventional hold portion, there was never a thought of attaching the small-flush cam locking portion to the bottom end, and attachment was difficult, but in the present invention this problem is solved by contriving a method for supporting a float hold shaft.

The small-flush cam lock portion 94 is linked to the vicinity of the bottom end portion 98*c* of the float hold shaft 98, and is formed to be lockable to the valve body main shaft 76. The small-flush cam lock portion 94 is disposed below the small-flush float 96. The small-flush cam lock portion 94 is formed in a generally T shape as seen in plane view.

The small-flush cam lock portion 94 comprises: a linking portion 94*a* linking between the float hold shaft 98 bottom end flange 102 and the lower portion top flange 104 at one end, a locking raised portion 94*b* locking to the valve body main shaft 76 shared projecting portion 80 on the other end, and a small-flush cam rotary shaft 94*c* formed at both horizontal end portions of the T shape of the small-flush cam lock portion 94 close to the valve body main shaft 76 as seen from the top surface.

The linking portion 94*a* is formed in a C shape opening toward the outside, and formed to sandwich the valve body 74 between two divided lateral arm portions. The linking portion 94*a* is linked to the float hold shaft 98 in a way which sandwiches the float hold shaft 98. Hence the linking portion 94*a* moves up and down to match the up and down movement of the float hold shaft 98. The linking portion 94*a* is linked between the float hold shaft 98 bottom end flange 102 and the lower portion top flange 104, therefore movement in the up-down direction is limited to the space between the bottom end flange 102 and the lower portion top flange 104. In the present embodiment the linking portion 94*a* is linked to the vicinity of the bottom end portion of the float hold shaft 98, but so long as the small-flush cam lock portion 94 is positioned below the large-flush cam lock portion 114, the linking portion 94*a* may be linked at a position above the bottom end portion of the float hold shaft 98.

The locking raised portion 94*b* forms an upward projecting raised portion. More specifically, the locking raised portion 94*b* is formed in a trapezoidal shape as seen from the side, and the long side 94*d* on the valve body main shaft side is formed to project further upward than the short side 94*e* on the float hold shaft side, forming a diagonally sloping surface from the top end of the long side 94*d* to the top end of the short side 94*e*. The locking raised portion 94*b* is formed as a square as seen in plane view. Centered on the small-flush cam rotary shaft 94*c*, the orientation of the locking raised portion 94*b* is rotated in response to the up-down movement of the linking portion 94*a*; i.e., the position of the top end of the long side 94*d* of the locking raised portion 94*b* is rotated. When the locking raised portion 94*b* is at the position to which the linking portion 94*a* rises, the top end of the long side 94*d* is rotated (tilted) so as to approach the valve body main shaft side. When the locking raised portion 94*b* is at the position to which the linking portion 94*a* drops, the top end of the long side 94*d* is rotated (tilted) so as to move away from the valve body main shaft side.

This small-flush cam rotary shaft 94*c* is supported by a bearing 108 protruding upward from the peak portion 60*a* of the discharge port portion 60. The small-flush cam rotary shaft 94*c* is rotatably attached to the bearing 108.

The large-flush float mechanism 54 comprises a large-flush float 110, which drops together with the water level when the water level in the reservoir tank 6 drops to the water level at which a specified large-flush water amount is discharged, an inside control reservoir portion 112 containing the large-flush float 110, and a large-flush cam lock portion 114, whereby the lock between the large-flush cam lock portion 114 and the valve body main shaft 76 is released by the drop of the large-flush float 110.

This large-flush float 110 is contained in the inside control reservoir portion 112. The large-flush float 110 is a columnar member of which the horizontal cross sectional shape is generally a semicircle carved out at the center, having a predetermined height. The majority of the large-flush float 110 is disposed inside the inside control reservoir portion 112, and is buoyed according to the water level in the inside control reservoir portion 112. The large-flush float 110 is disposed at a height position below the small-flush float 96.

The large-flush cam lock portion 114 comprises: a pair of arm portions 114*a* extending in a straight line diagonally upward from the top ends on both sides of this large-flush float 110 to the opposite side of the valve body main shaft 76; a pair of large-flush cam rotary shafts 114*b* formed to respectively project from the top end portions of these arm portions 114*a*; and a locking indented portion 114*c*, extending a predetermined length downward from the center of the top portions of the arm portions 114*a*, formed on the tip portion, and able to lock the valve body main shaft 76 and the shared projecting portion 80.

The arm portions 114*a* are respectively connected to the top ends 110*a* on both sides of the large-flush float 110. Therefore the large-flush cam lock portion 114 arm portions 114*a* move up and down to match the up and down movement of the large-flush float 110. The arm portions 114*a* respectively extend from the top ends 110*a* on both sides of the large-flush float 110 through the region on both outer sides of the valve body main shaft 76, to the top end portion 114*d* on the opposite side of the valve body main shaft 76. The arm portions 114*a* as seen in plane view are formed in a U shape, so that the top end portions thereof connect the top end portions 114*d* of the arm portions 114*an* in the transverse direction.

The large-flush cam rotary shafts 114*b* are rotatably attached to a pair of hub portions (not shown) disposed on the inside wall of the body portion 56 of the casing 46.

The locking indented portion 114*c* is formed at the tip portion of a member extending downward from the center of the top end portion 114*d* of the arm portions 114*a*. The locking indented portion 114*c* is formed to open in an indented shape toward the valve body main shaft 76 as seen in side view. In the locking indented portion 114*c*, the lateral indented bottom side 114*e* can lock with the shared projecting portion 80 like a hook. Centered on the large-flush cam rotary shaft 114*b*, the orientation of the locking indented portion 114*c* is rotated in response to up and down movement of the arm portions 114*a* of the large-flush float 110 sides; i.e., the orientation of the bottom side 114*e* on the locking indented portion 114*c* is rotated.

When the large-flush float 110 side of the arm portions 114*a* is at a raised position, the locking indented portion 114*c* is rotated so that the bottom side 114*e* approaches the valve body main shaft side, and the bottom side 114*e* has a lateral (or close to lateral) tilt. When the arm portion 114*a* large-flush float 110 side is in a dropped position, the locking indented portion 114*c* is rotated so as move away from the valve body main shaft side, and the bottom side 114*e* is tilted diagonally. Hence this large-flush cam lock portion 114 is formed so that the lock with the valve body main shaft 76 shared projecting portion 80 is released by the lowering of the large-flush float 110.

The inside control reservoir portion 112 is attached to the top of the discharge port portion 60 peak portion 60*a*, and controls the motion of the valve body portion 48 in the large-flush mode. The top portion of the inside control reservoir portion 112 opens to the inside and above the casing 46, and a small hole 112*a* is formed on the bottom portion thereof. When discharging flush water from the reservoir tank 6, the inside control reservoir portion 112 by this structure is able to control the drop speed of the water level in the inside control reservoir portion 112 so it differs from the drop speed of the water level inside the reservoir tank 6. Therefore as described below, the inside control reservoir portion 112 can independently control the timing at which the large-flush float 110 starts to drop (the timing for starting the opening and closing action).

When the upward buoyancy force relative to the large-flush float 110 from the flush water stored in the inside control reservoir portion 112 exceeds the downward dead weight of the large-flush float 110, the large-flush float 110 rises inside the inside control reservoir portion 112. When the large-flush float 110 upward buoyancy force is less than the downward dead weight of the large-flush float 110, the large-flush float 110 drops inside the inside control reservoir portion 112.

Placement of the large-flush float 110 in the inside control reservoir portion 112 enables the control of the up and down motion of the large-flush float 110 in response to the water level inside the inside control reservoir portion 112, i.e., of the rotational movement of the large-flush float mechanism 54 around the large-flush cam rotary shaft 114*b*.

On the inside control reservoir portion 112, below the side perimeter wall portion thereof, a small hole 112*a* is formed to control the flow volume, allowing flush water in the inside control reservoir portion 112 to flow into the reservoir tank 6 outside the inside control reservoir portion 112. The small hole 112*a* is formed in a slit shape, and the hole size can be varied.

The speed differential between the drop speed of the water level in the reservoir area of the inside control reservoir portion 112 and the drop speed of the water level outside the inside control reservoir portion 112 increases in proportion to how small the opening surface area of the small hole 112*a* is set; the timing at which the valve body main shaft 76 and valve body 74 drop action (valve closing action) is started is delayed, the dead water level (DWL) inside the reservoir tank 6 at the time a discharge is completed is lowered, and the total amount of flush water supplied from the reservoir tank 6 to the toilet main body 2 during the large-flush mode is set higher.

Conversely, the speed differential between the drop speed of the water level in the reservoir area of the inside control reservoir portion 112 and the drop speed of the water level outside the inside control reservoir portion 112 decreases in proportion to how large the opening surface area of the small hole 112*a* is set; the timing at which the valve body main shaft 76 and valve body 74 drop action (valve closing action) is started is sped up, the dead water level (DWL) inside the reservoir tank 6 at the time a discharge is completed is raised, and the total amount of flush water supplied from the reservoir tank 6 to the toilet main body 2 during the large-flush mode is set lower.

On the body portion 56 of the casing 46, a casing opening (not shown) is partially formed near the small hole 112*a*, and communication between the interior of the reservoir tank 6 and the interior of the inside control reservoir portion 112 is made possible by the casing opening in the casing 46. Hence flush water inside the inside control reservoir portion 112 can be made to flow from the small hole 112*a* into the reservoir tank 6 through the casing opening in the casing 46.

Note that in the present embodiment the large-flush float mechanism 54 comprises an inside control reservoir portion 112, but it is also acceptable for the large-flush float mechanism 54 not to comprise an inside control reservoir portion 112. At this point, the large-flush float 110 is moved up and down according to the water level in the reservoir tank 6.

In the present invention, it was conceived that in order to lower the height of the discharge valve apparatus 28, it would be effective to form the valve body portion 48 being raised (roughly the height of the valve body main shaft 76) at a relatively low height. Here the valve body portion 48 is formed to rise vertically from the valve body 74 to a predetermined height H1. The casing 46 requires a total height H3 up to the lid portion 58 having at least the range of motion of the valve body portion 48 height H1 and the valve body 74 pull-up height H2.

Conventionally, because the small-flush float 96 is disposed at a position higher than the large-flush float 110, the small-flush cam lock portion linked to the small-flush float 96 is disposed at a position higher than the large-flush cam lock portion. Therefore in the valve body portion 48 valve body main shaft 76, conventionally, a small-flush projecting portion for locking with the small-flush cam lock portion had to be provided at a position higher than the large-flush projecting portion for locking with the large-flush cam lock portion.

In contrast, in the valve body portion 48 valve body main shaft 76 of the present invention, the omission of a conventional small-flush projecting portion for locking with a small-flush cam lock portion enables the omission and shortening of the length of the part higher than the large-flush projecting portion of the valve body main shaft 76, so that the valve body portion 48 can be formed at a relatively low height.

The resulting ability to form the valve body portion 48 height H1 at a relatively low height enables the total height H3 up to the casing 46 lid portion 58 to be formed at a relatively low height. Because the height of the discharge valve apparatus 28 casing 46 can be formed to be relatively low, the height of the reservoir tank 6 housing the discharge valve apparatus 28 can be made low, and a reduced silhouette for the flush toilet 1 in which the reservoir tank 6 is disposed can be achieved.

When the manual operation apparatus 18 is a pushbutton-type of manual operating apparatus, because the pushbutton pull-up mechanism, etc. is housed inside the discharge valve apparatus 28, the height of the discharge valve apparatus 28 can easily become a tall structure, but in the present invention the height of the discharge valve apparatus 28 can be formed to be relatively low.

Also, by reducing the height of the discharge valve apparatus 28, the volume of the resin, etc. used to form the discharge valve apparatus 28 can be reduced, thereby lowering cost.

Next, referring to FIG. 2 and FIGS. 7 through 14, we explain the operation (action) of a discharge valve apparatus, a flush water tank apparatus comprising this discharge valve apparatus, and a flush toilet comprising this flush water tank apparatus, according to the an embodiment of the invention.

Figure 8:
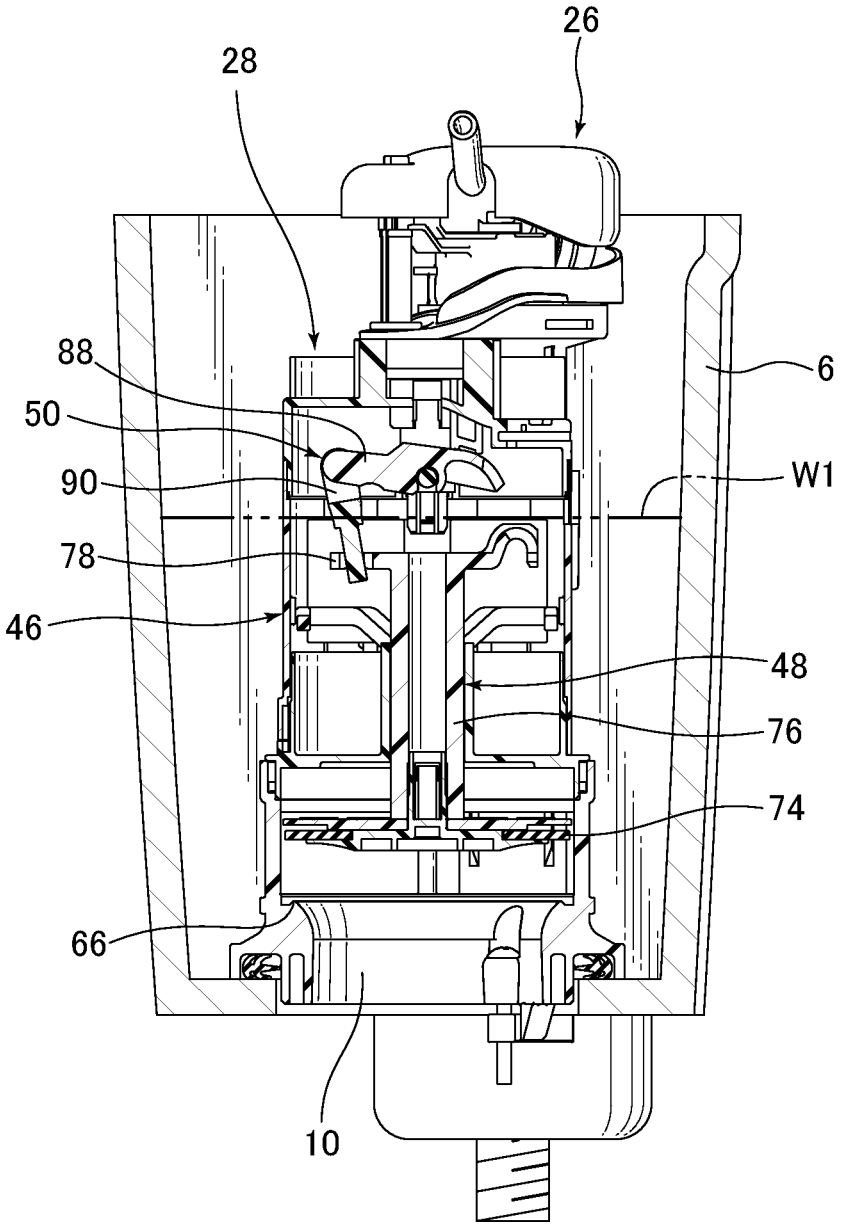
FIG. 8 is a partial cross section seen along line III-III in FIG. 1, showing the state immediately after the valve body has been raised to start the small-flush mode in a discharge valve apparatus according to an embodiment of the invention.
Figure 9:
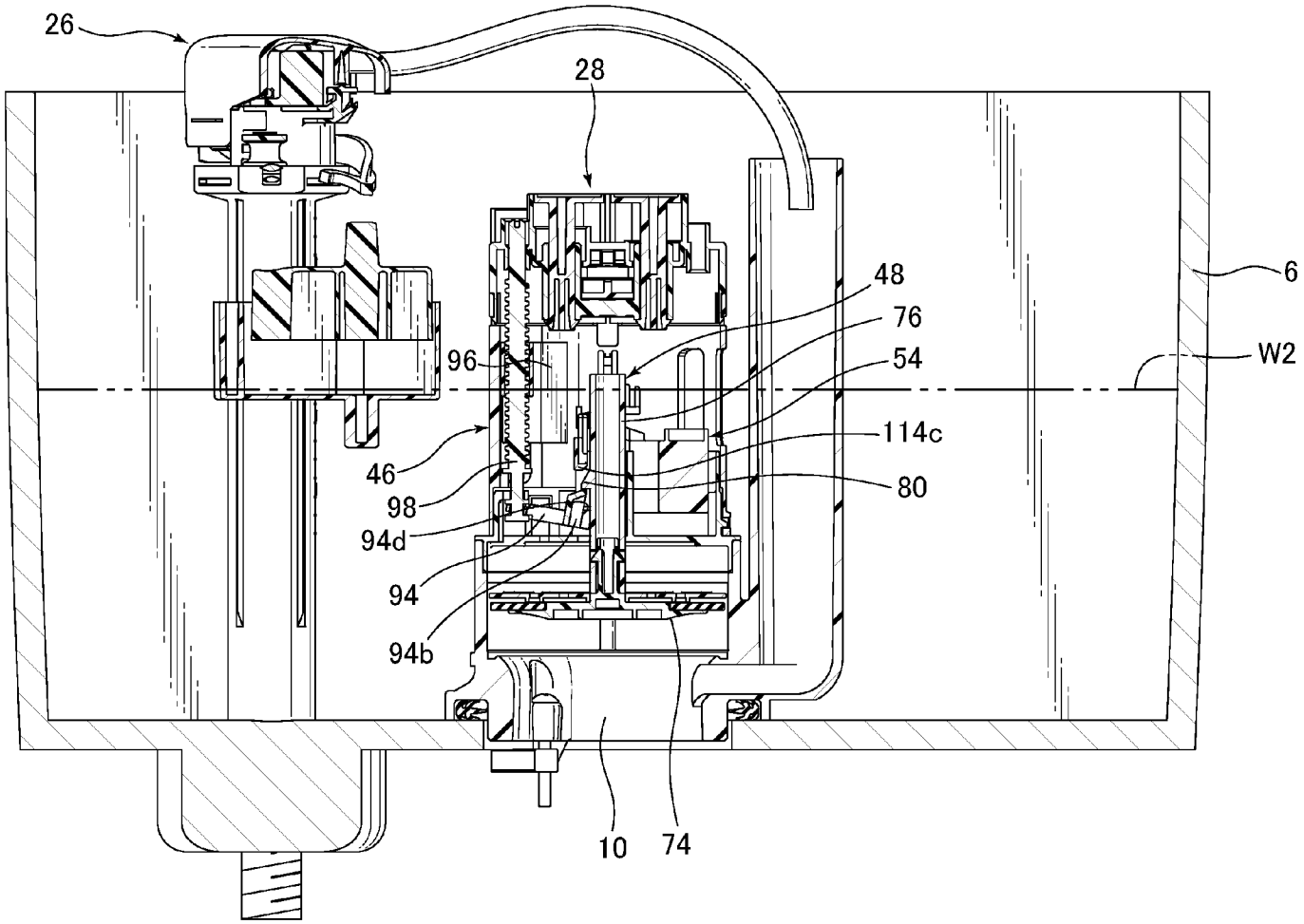
FIG. 9 is a partial cross section seen along line II-II in FIG. 1, showing the state midway through discharge in which the shared projecting portion is locked to the small-flush cam lock portion, in the small-flush mode of a discharge valve apparatus according to an embodiment of the invention.
Figure 10:
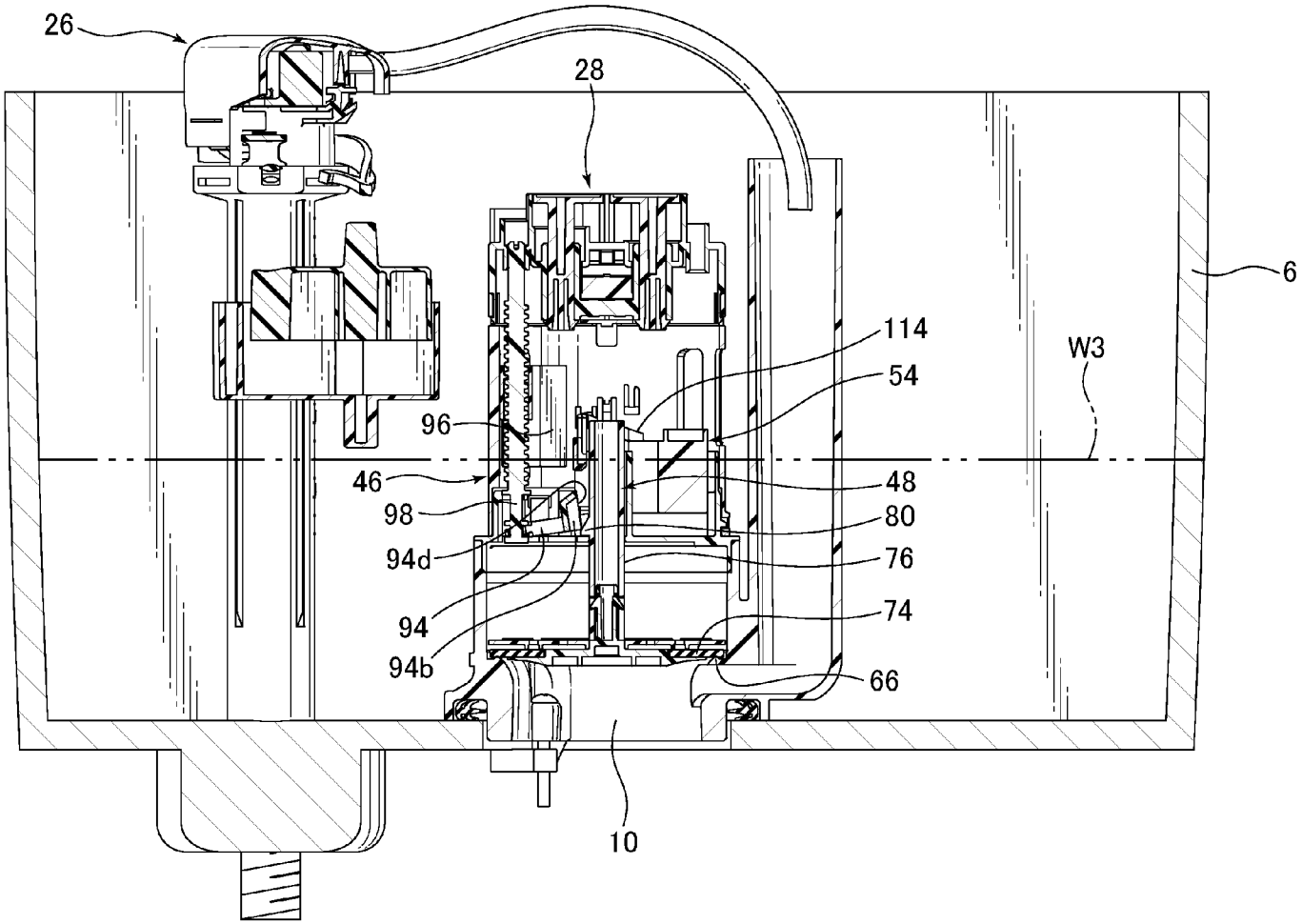
FIG. 10 is a partial cross section seen along line II-II in FIG. 1, showing the state when discharge is completed in the small-flush mode of a discharge valve apparatus according to an embodiment of the invention.
Figure 11:
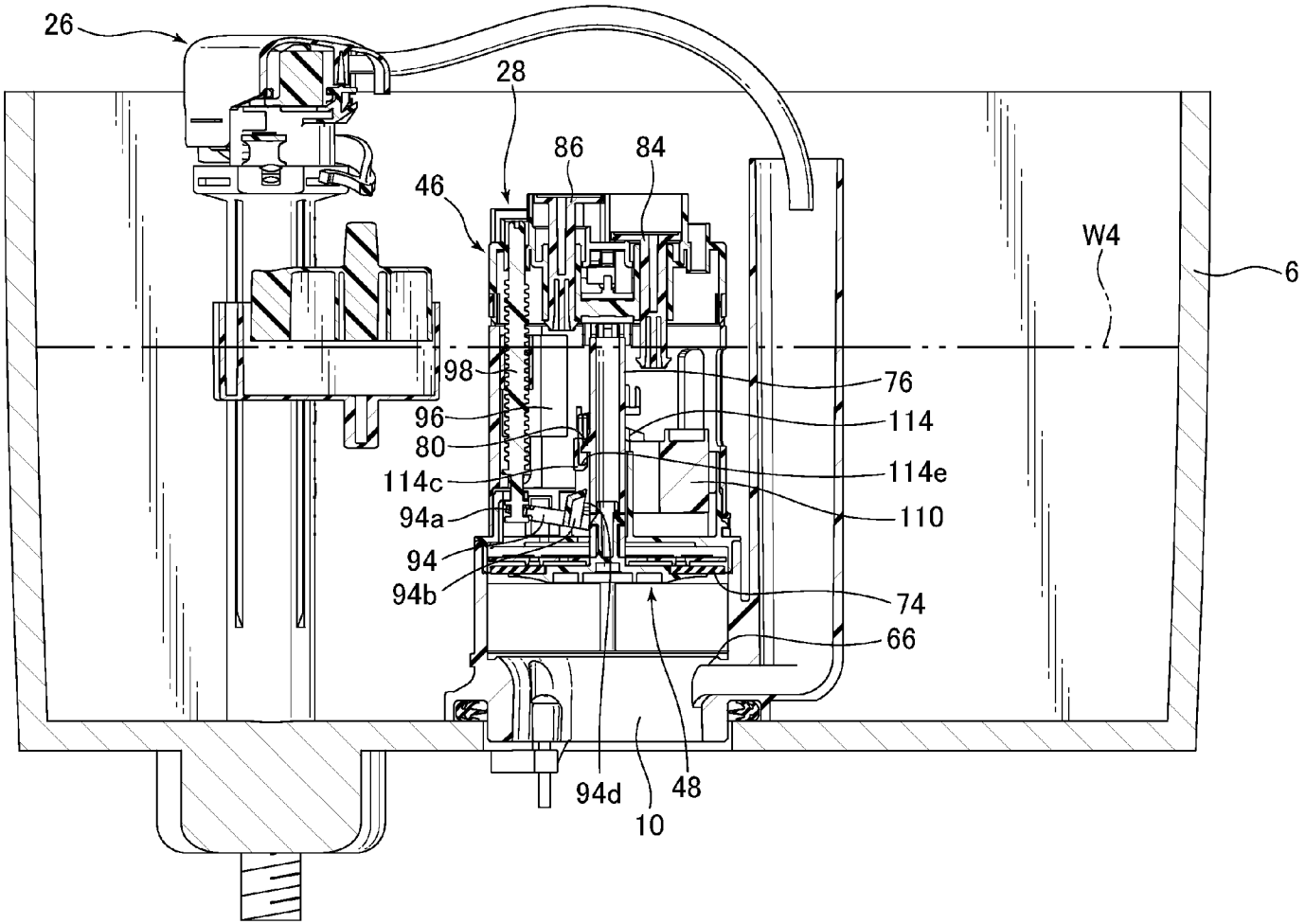
FIG. 11 is a partial cross section seen along line II-II in FIG. 1, showing the state immediately after the valve body has been raised to start the large-flush mode in a discharge valve apparatus according to an embodiment of the invention.
Figure 12:
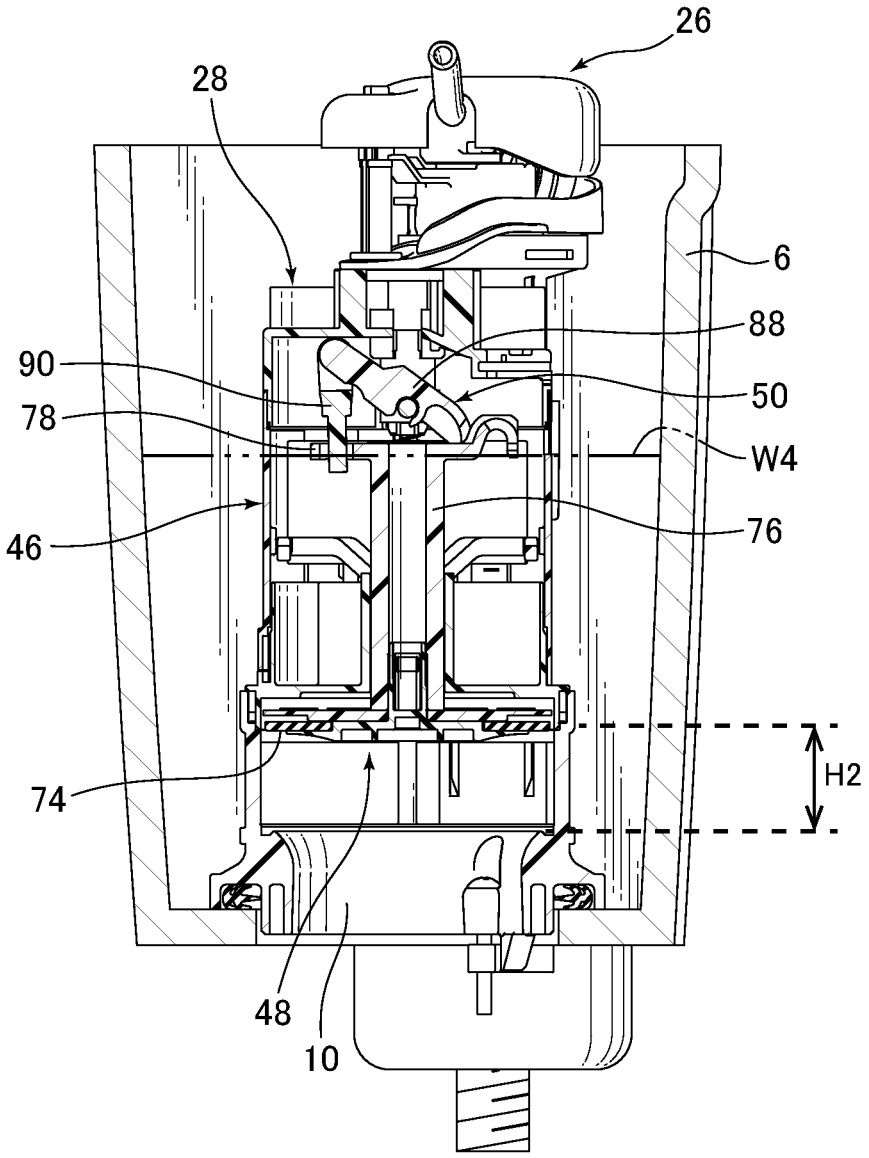
FIG. 12 is a partial cross section seen along line III-III in FIG. 1, showing the state immediately after the valve body has been raised to start the large-flush mode in a discharge valve apparatus according to an embodiment of the invention.
Figure 13:
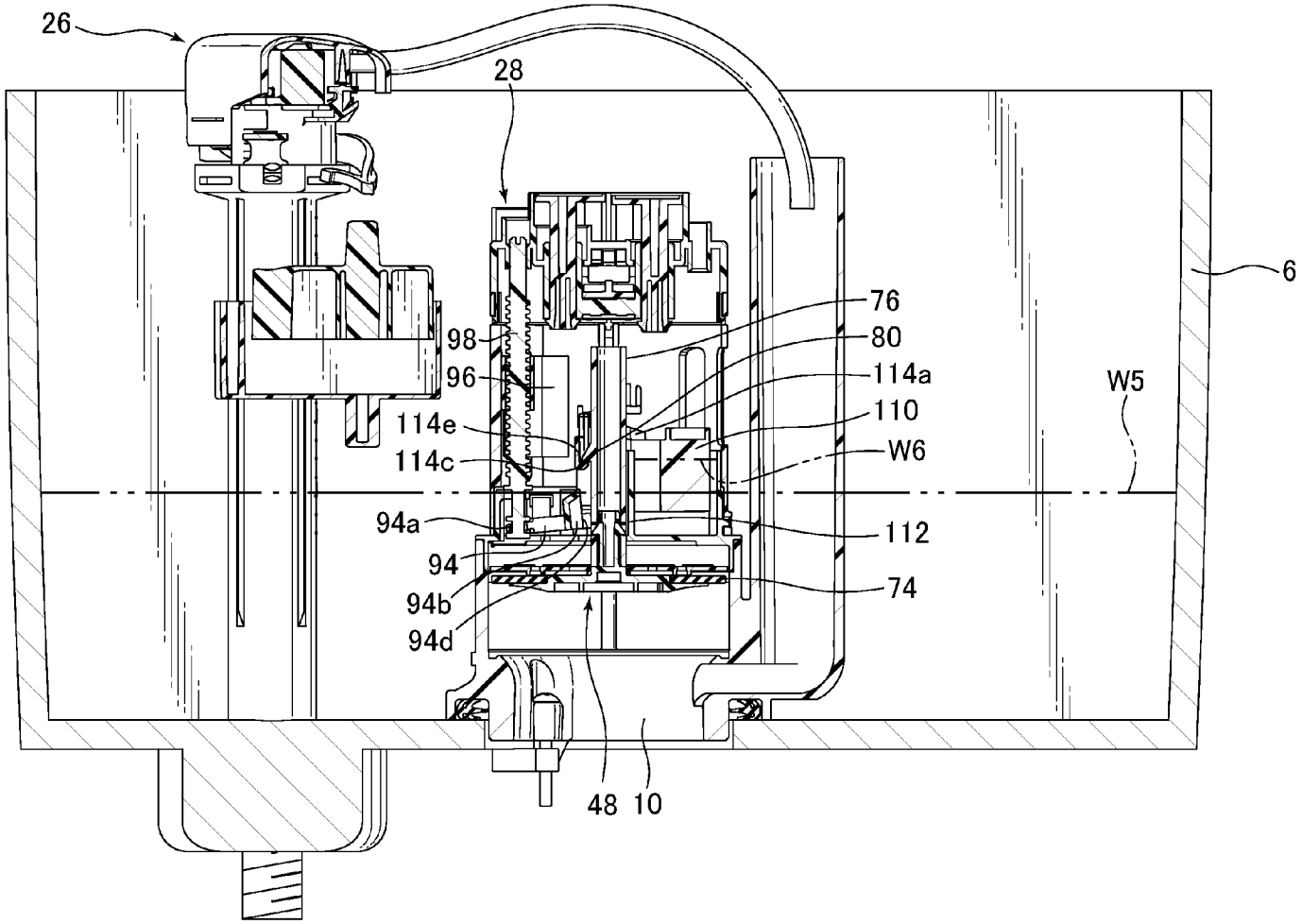
FIG. 13 is a partial cross section seen along line II-II in FIG. 1, showing the state midway through discharge in which the shared projecting portion is locked to the large-flush cam lock portion, in the large-flush mode of a discharge valve apparatus according to an embodiment of the invention.
Figure 14:
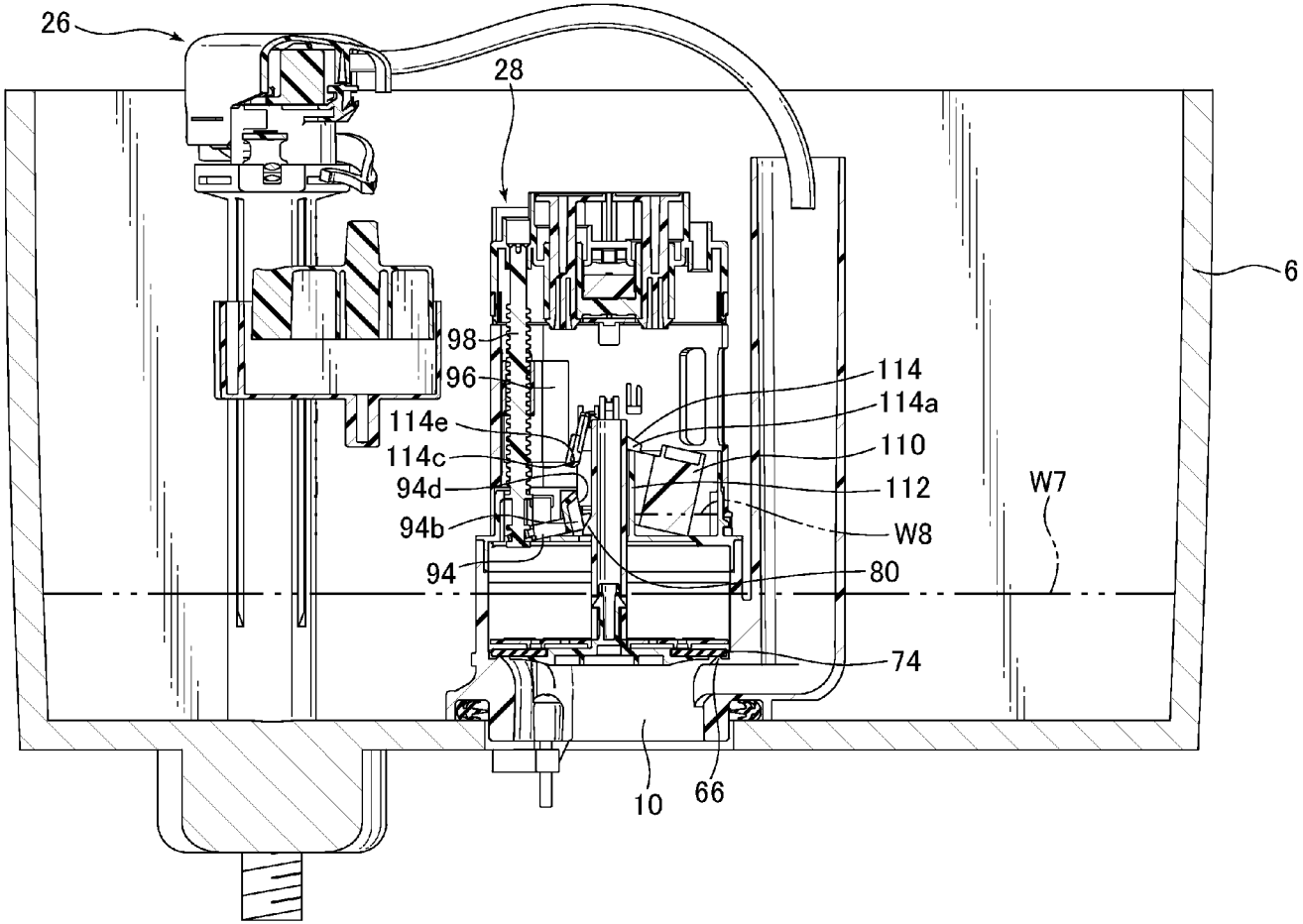
FIG. 14 is a partial cross section seen along line II-II in FIG. 1, showing the state when discharge is completed in the large-flush mode of a discharge valve apparatus according to an embodiment of the invention.

FIG. 8 is a partial cross section seen along line III-III in FIG. 1, showing the state immediately after the valve body has been raised to start the small-flush mode in a discharge valve apparatus according to an embodiment of the invention; FIG. 9 is a partial cross section seen along line II-II in FIG. 1, showing the state midway through discharge in which the shared projecting portion is locked to the small-flush cam lock portion, in the small-flush mode of a discharge valve apparatus according to an embodiment of the invention; FIG. 10 is a partial cross section seen along line II-II in FIG. 1, showing the state when discharge is completed in the small-flush mode of a discharge valve apparatus according to an embodiment of the invention; FIG. 11 is a partial cross section seen along line II-II in FIG. 1, showing the state immediately after the valve body has been raised to start the large-flush mode in a discharge valve apparatus according to an embodiment of the invention; FIG. 12 is a partial cross section seen along line III-III in FIG. 1, showing the state immediately after the valve body has been raised to start the large-flush mode in a discharge valve apparatus according to an embodiment of the invention; FIG. 13 is a partial cross section seen along line II-II in FIG. 1, showing the state midway through discharge in which the shared projecting portion is locked to the large-flush cam lock portion, in the large-flush mode of a discharge valve apparatus according to an embodiment of the invention; FIG. 14 is a partial cross section seen along line II-II in FIG. 1, showing the state when discharge is completed in the large-flush mode of a discharge valve apparatus according to an embodiment of the invention.

First, using FIGS. 2, 3, and 7 through 10, we explain the small-flush mode of the two types of flush mode executable using a flush water tank apparatus comprising a discharge valve apparatus according to an embodiment of the invention.

As shown in FIG. 2, in the state prior to start of discharge in the voltage source 28 small-flush mode, the valve body 74 contacts the valve seat 66 and the discharge port 10 is closed; the water level in the reservoir tank 6 goes to shutoff water level Wf; flush water in the reservoir tank 6 stored outside the casing 46 passes through the slits 56*a* formed in the body portion 56 of the casing 46 into the casing 46, and the large-flush float 110 and small-flush float 96 are submerged.

The locking raised portion 94*b* of the small-flush cam lock portion 94 is positioned above the shared projecting portion 80 of the valve body main shaft 76, and neither is locked. The large-flush cam lock portion 114 is also positioned above the shared projecting portion 80 of the valve body main shaft 76, and neither is locked.

Next, as shown in FIGS. 7 and 8, when the discharge valve apparatus 28 is in the valve-open state in the small-flush mode, the small-flush operating portion 86 is pushed down in response to a user depressing the small-flush button 40 formed on the lid 8 (see FIG. 1). Pushing down the small-flush operating portion 86 results in the rotation of the first rotary link 88 on the pull-up mechanism 50 by a relatively small rotational amount, and the pulling up of the second link 90 by a relatively small pull-up amount H4. The planar attaching portion 78 on the bottom end portion of the second link 90 can be pulled up, raising the entire valve body portion 48. The valve body main shaft 76 of the valve body portion 48 is pulled up to a predetermined height position below the maximum height, releasing the discharge port 10.

At this point the raised height (stroke) H of the valve body 74 relative to the valve seat 66 is H4, which is lower than the maximum raised height H2 in the large-flush mode, and small-flush mode discharge to the toilet main body 2 of the flush toilet 1 by the discharge valve apparatus 28 on the reservoir tank 6 is started. Flush water is discharged from the discharge port 10, and the water level inside the reservoir tank 6 starts to fall as shown by the water level W1.

The shared projecting portion 80 of the valve body main shaft 76 on valve body portion 48 is pulled up to a position above the locking raised portion 94*b* of the small-flush cam lock portion 94. In the small-flush mode, because the shared projecting portion 80 is at a position below the locking indented portion 114*c* of the large-flush cam lock portion 114, it does not lock to the large-flush cam lock portion 114.

The small-flush float 96 rises as a single piece with the float hold shaft 98 due to its own buoyancy, raising the small-flush cam lock portion 94 linking portion 94*a*. The small-flush cam lock portion 94 is rotated about the small-flush cam rotary shaft 94*c*, rotating (tilting) the top end of the locking raised portion 94*b* long side 94*d* so that it approaches the valve body main shaft side. Thus when the shared projecting portion 80 is raised by the small-flush mode pull-up amount H4, it is positioned at a position above the locking raised portion 94*b*, such that it can lock with the small-flush cam lock portion 94 locking raised portion 94*b*, as described below.

As shown in FIG. 9, when the valve body portion 48 drops under its own weight, the valve body main shaft 76 shared projecting portion 80 locks to the small-flush cam lock portion 94 locking raised portion 94*b*, restricting the dropping action (valve closing action) of the valve body main shaft 76 and valve body 74. Flush water is supplied from the discharge port 10 to the toilet main body 2.

Next, as shown in FIG. 10, in the mid-discharge state in the small-flush mode of the discharge valve apparatus 28, together with the discharge from the discharge port 10 to the toilet main body 2 the water level inside the reservoir tank 6 and the water level inside the casing 46 drop to a water level below that of the water level W2 shown in FIG. 9, therefore the buoyancy of the small-flush float 96 diminishes in tandem with the drop in this water level, and the small-flush float 96 and the float hold shaft 98 locked to it drop as a single unit.

When the water level inside the reservoir tank 6 drops to a water level at which a predetermined small-flush amount is discharged, the small-flush float 96 starts to drop together with the water level; when the small-flush float 96 drops and discharge is completed as discussed below, the water level reaches dead water level W3, and a predetermined small-flush amount (approximately the flush water amount discharged from the reservoir tank 6 from the full water level Wf to the dead water level W3) is supplied to the toilet main body 2.

When the float hold shaft 98 drops, the small-flush cam lock portion 94 linking portion 94*a* is lowered. The small-flush cam lock portion 94 is rotated about the small-flush cam rotary shaft 94*c*, rotating (tilting) the top end of the locking raised portion 94*b* long side 94*d* so that it approaches the float support main shaft side. Hence the lock between the shared projecting portion 80, the locking raised portion 94*b*, and the small-flush rod member 44 is released, and the shared projecting portion 80 drops along the long side 94*d* of the locking raised portion 94*b*. At this point, the valve body main shaft 76 and valve body 74 drop together with the falling water level, and the valve closing action in the small-flush mode of the discharge valve apparatus 28 is started.

The large-flush cam lock portion 114 of the large-flush float mechanism 54 is positioned above the shared projecting portion 80 at this time, and both are unengaged, so the valve closing operation is not impeded by the drop in the valve body main shaft 76 and valve body 74.

Next, when the valve body main shaft 76 and valve body 74 drop together with the fall in water level, the valve body 74 contacts the valve seat 66 as shown in FIG. 10, and discharge by the discharge valve apparatus 28 in the small-flush mode is completed.

In the discharge completed state, the water level inside the reservoir tank 6 and the water level inside the casing 46 drop to a water level W3 below the water level W1 shown in FIG. 9, reaching the dead water level (DWL). This small-flush mode dead water level W3 (DWL) is higher than the dead water level W7 (DWL) during the large-flush mode shown in FIG. 14.

Thereafter, flush water is supplied by the water supply apparatus 26 up to the water level Wf in reservoir tank 6, and the flushing operation in the small-flush mode is completed. The state whereby flush water is supplied up to the water level Wf in the reservoir tank 6 is the pre-discharge start state in the discharge valve apparatus 28 small-flush mode.

Next, using FIGS. 11 through 14, we explain the large-flush mode of the two types of flush mode executable using a flush water tank apparatus comprising a discharge valve apparatus according to an embodiment of the invention.

First, the discharge valve apparatus 28 in the state prior to the start of discharge in the large-flush mode shown in FIG. 2 is the same as the small-flush mode shown in FIG. 2, so an explanation thereof is omitted.

Next, as shown in FIGS. 11 and 12, in the state at the time of valve opening in the discharge valve apparatus 28 large-flush mode, when a user depresses the large-flush button 38 formed in the lid 8, the large-flush operating portion 84 is pushed down in response. Pushing down the large-flush operating portion 84 results in the rotation of the first rotary link 88 on the pull-up mechanism 50 by a relatively large rotational amount, and the pulling up of the second link 90 by a relatively large pull-up amount H2. The planar attaching portion 78 on the bottom end portion of the second link 90 can be pulled up, raising the entire valve body portion 48. The valve body main shaft 76 of the valve body portion 48 is pulled up to the maximum height position, releasing the discharge port 10.

At this point, the raised height (stroke) H of the valve body 74 relative to the valve seat 66 is at the maximum height (maximum stroke) H2 above the height H4 to which it is pulled up in the small-flush mode (H2>H4), and discharge in the large-flush mode to the flush toilet 1 toilet main body 2 by the discharge valve apparatus 28 on the reservoir tank 6 is started.

At this point, the shared projecting portion 80 of the valve body main shaft 76 of the valve body portion 48 is pulled up to a position above the locking indented portion 114*c* of the large-flush cam lock portion 114. In addition, the shared projecting portion 80 is also pulled up to a position above the locking raised portion 94*b* of the small-flush cam lock portion 94.

In the inside control reservoir portion 112, the large-flush float 110 is raised by its own buoyancy, raising the arm portions 114*a* of the large-flush cam lock portion 114. The large-flush cam lock portion 114 is rotated about the large-flush cam rotary shaft 114*b*; the locking indented portion 114*c* bottom side 114*e* is rotated (tilted) so as to approach the valve body main shaft side, and the bottom side 114*e* has a lateral (or close to lateral) tilt.

Also, the small-flush float 96 rises as a single piece with the float hold shaft 98 due to its own buoyancy, raising the small-flush cam lock portion 94 linking portion 94*a*. The small-flush cam lock portion 94 is rotated about the small-flush cam rotary shaft 94*c*, rotating (tilting) the top end of the locking raised portion 94*b* long side 94*d* so that it approaches the valve body main shaft side. Thus when the shared projecting portion 80 is raised by the large-flush mode pull-up amount H2, it is positioned at a position above the locking indented portion 114*c*, such that it can lock with the large-flush cam lock portion 114 locking indented portion 114*c*, as described below.

As shown in FIG. 13, when the valve body portion 48 drops under its own weight, the valve body main shaft 76 shared projecting portion 80 locks to the large-flush cam lock portion 114 locking indented portion 114*c*, restricting the dropping action (valve closing action) of the valve body main shaft 76 and valve body 74. Flush water is supplied from the discharge port 10 to the toilet main body 2. Here the shared projecting portion 80 locks to the large-flush cam lock portion 114 locking indented portion 114*c*, therefore it does not engage the small-flush cam lock portion 94.

As shown in FIG. 13, in the valve open state in the discharge valve apparatus 28 large-flush mode, the valve body 74 rises to a maximum height H2 relative to the valve seat 66 and the discharge port 10 is released, so that the water level inside the reservoir tank 6 drops suddenly to water level W5. The flush water inside the reservoir tank 6 and flush water inside the casing 46 are in communication through the slits 56*a* etc. in the casing 46, therefore the flush water inside the casing 46 also goes to the W5 water level. The speed at which the water level in the inside control reservoir portion 112 drops at this time differs from the water level drop speed in the reservoir tank 6. Within the inside control reservoir portion 112, flush water is still accumulated up to the water level W6.

Next, as shown in FIG. 13, the flush water within the inside control reservoir portion 112 flows out gradually from the small hole 112*a* on the lower part thereof. A differential arises between the flush water level drop speed in the inside control reservoir portion 112 and the water level drop speed inside the external reservoir tank 6, delaying the timing of the start of the drop of the large-flush float 110. The timing of the start of the drop of the large-flush float 110 is in this way delayed, so that as shown in FIG. 14, flush water inside the reservoir tank 6 can be sufficiently discharged to a level below the large-flush float 110.

As shown in FIG. 13, even when the flush water level W5 is positioned on the lower portion within the inside control reservoir portion 112, the inside control reservoir portion 112 large-flush float 110 is in a submerged state (buoyed by water). The large-flush float 110 is raised by its own buoyancy, the large-flush cam lock portion 114 arm portions 114*a* are raised, and a state is maintained whereby the locking indented portion 114*c* bottom side 114*e* locks to the shared projecting portion 80.

In contrast, the small-flush float 96 is exposed above the water level W5. Hence the small-flush float 96 and the float hold shaft 98 are dropping. When the float hold shaft 98 drops, the small-flush cam lock portion 94 linking portion 94*a* is lowered. The small-flush cam lock portion 94 is rotated about the small-flush cam rotary shaft 94*c*, rotating (tilting) the top end of the locking raised portion 94*b* long side 94*d* so that it approaches the float support main shaft side. Therefore the long side 94*d* on the locking raised portion 94*b* of the small-flush cam lock portion 94 does not engage even when the shared projecting portion 80 drops down.

Next, as shown in FIG. 14, when the water level inside the reservoir tank 6 reaches the still further lowered water level W7, and the water level W8 in the inside control reservoir portion 112 drops, the large-flush float 110 falls. The arm portion 114*a* of the large-flush cam lock portion 114 is lowered and rotated about the large-flush cam rotary shaft 114*b*, and the bottom side 114*e* of the locking indented portion 114*c* is rotated (tilted) so as to move away from the valve body main shaft side. Hence the locking between the shared projecting portion 80 and the locking indented portion 114*c* is released, and the shared projecting portion 80 drops. At this point, as described above, the small-flush float 96 is already in a dropped state, and the top end of the long side 94*d* of the locking raised portion 94*b* is rotated (tilted) so as to approach the float hold shaft side. Hence the shared projecting portion 80 drops along the long side 94*d* of the locking raised portion 94*b* without the shared projecting portion 80 and the locking raised portion 94*b* being engaged. By so doing, the valve body main shaft 76 and valve body 74 drop together with the falling water level, and the valve closing action in the small-flush mode of the discharge valve apparatus 28 is started.

When the water level inside the reservoir tank 6 drops to a water level at which a predetermined large-flush amount is discharged, the large-flush float 110 starts to fall along with the water level. In this embodiment, when the water level in the reservoir tank 6 drops to a predetermined water level, the large-flush float 110 drops to the water level in the inside control reservoir portion 112. When the water level in the inside control reservoir portion 112 drops to water level W8, the large-flush float 110 falls, and as described below when discharge is completed the water level in reservoir tank 6 goes to dead water level W7, whereby a predetermined large-flush water amount (approximately the flush water amount discharged from the reservoir tank 6 from the full water level Wf to the dead water level W7) is supplied to the toilet main body 2. Hence the amount of flush water discharged from the reservoir tank 6 can be determined by the drop in the water level in the inside control reservoir portion 112, which is slightly delayed relative to the drop in the water level inside the reservoir tank 6.

The valve body main shaft 76 and valve body 74 contact the valve seat 66, the discharge port 10 is closed, and discharge in the large-flush mode of the discharge valve apparatus 28 is completed.

In the discharge completed state, the water level inside the reservoir tank 6 and the water level inside the casing 46 drop to a water level W7 below the dead water level W3 at the time of the small-flush mode shown in FIG. 10, reaching the dead water level (DWL).

Thereafter flush water is supplied by the water supply apparatus 26 up to the water level Wf in reservoir tank 6, and the flushing operation in the large-flush mode is completed. The state in which flush water is supplied up to the water level Wf in the reservoir tank 6 is the pre-discharge start state in the discharge valve apparatus 28 large-flush mode.

Using the discharge valve apparatus 28 according to the above-described embodiment of the invention, the valve body portion 48 and valve body main shaft 76 single shared projecting portion 80 locks to the large-flush cam lock portion 114 when pulled up by the large-flush mode pull-up amount, locks to the small-flush cam lock portion 94 when pulled up by the small-flush mode pull-up amount and, in the large-flush mode and small-flush mode, with the valve body pulled up, discharges flush water from the reservoir tank 6 discharge port 10 to the toilet main body 2.

In the small-flush mode, when the water level in the flush water tank 6 drops to the water level at which a specified small-flush water amount is discharged, the drop of the small-flush float 96 in tandem with the water level causes the lock between the small-flush cam lock portion 94 and the single shared projecting portion 80 of the valve body main shaft 76 to be released so that the valve body falls and the discharge port 10 is closed.

In the large-flush mode, when the water level in the flush water tank 6 drops to the water level at which a specified large-flush water amount is discharged, the drop of the large-flush float 110 in tandem with the water level causes the lock between the large-flush cam lock portion 114 and the single shared projecting portion 80 of the valve body main shaft 76 to be released so that the valve body falls and the discharge port 10 is closed.

Thus the small-flush mode and the large-flush mode can be performed using a single shared projecting portion 80 of the valve body main shaft 76.

Therefore the valve body main shaft 76 has only a single shared projecting portion 80 relative to the small-flush cam lock portion 94 and large-flush cam lock portion 114, so the length of the valve body main shaft 76 can be shortened, and the height of the discharge valve apparatus 28 lowered, such that a discharge valve apparatus 28 capable of placement on a flush toilet 1 with a relatively low silhouette can be provided.

Also, using the discharge valve apparatus 28, the small-flush cam lock portion 94 is disposed at a position below the large-flush cam lock portion 114. When lifted up to the height of the large-flush cam lock portion 114, the valve body main shaft 76 single shared projecting portion 80 can lock with the large-flush cam lock portion 114, and when lifted up to the height of the small-flush cam lock portion 94, disposed at a position lower than the height of the large-flush cam lock portion 114, can lock with the small-flush cam lock portion 94.

Hence the small-flush cam lock portion 94 is not disposed at a position higher than the large-flush cam lock portion 114 as in the past. Thus the need is eliminated for disposing on the valve body main shaft a small-flush projecting portion corresponding to the small-flush cam lock portion, disposed at a position higher than the large-flush cam lock portion as in the past.

Therefore the valve body main shaft 76 has a single shared projecting portion 80 engaging the small-flush cam lock portion 94 disposed at a position lower than the large-flush cam lock portion 114, so the length of the valve body main shaft 76 can be shortened, and the height of the discharge valve apparatus 28 lowered, such that a discharge valve apparatus 28 capable of placement on a flush toilet 1 with a relatively low silhouette can be provided.

In addition, using the discharge valve apparatus 28 according to the present embodiment, the small-flush cam lock portion 94 is linked to the bottom end portion 98*c* of the float hold shaft 98, and therefore can engage with the shared projecting portion 80 at a relatively low position.

Therefore since the valve body main shaft 76 has a single shared projecting portion 80 at a relatively close position, the length of the valve body main shaft 76 can be shortened, the height of the discharge valve apparatus 28 lowered, and a discharge valve apparatus 28 disposable on a relatively low silhouette flush toilet 1 can be provided.

Also, using the discharge valve apparatus 28 according to the present embodiment, the casing 46 side hold portion 106 is able to slidably support the float hold shaft 98 from the side, so there is no need to deploy a bottom portion hold portion for supporting the bottom end portion of the float hold shaft from the bottom portion of the casing, as in the past.

Hence the small-flush cam lock portion 94 can be linked to the bottom end portion 98*c* of the float hold shaft 98, and the small-flush cam lock portion 94 can be disposed at a relatively low position.

In addition, using a discharge valve apparatus 28 according to the present embodiment, a male screw thread 98*a* for screwing into the small-flush float 96 is formed on the outer surface of the float hold shaft 98. Hence the height position of the small-flush float 96, which starts to drop in tandem with the water level in the reservoir tank 6 when the water level in the reservoir tank 6 drops to the water level for discharging a predetermined small-flush water amount, can be fine tuned along the male screw portion 98*a* of the float hold shaft 98. Therefore the predetermined small-flush water amount discharged to the toilet from the reservoir tank 6 can be fine tuned with relatively high precision without relying on a stepped adjustment as in the past, so that even when the flush water amount in the reservoir tank 6 is reduced due to the need for water conservation, for example, a predetermined small-flush water amount out of this reduced flush water volume can be adjusted with relatively high precision.

Moreover, using a flush water tank apparatus 4 according to the present embodiment, a flush water tank apparatus 4 with a relatively low silhouette can be provided, in which the discharge valve apparatus 28 is placed at a low height.

Also, using the flush toilet 1 according to the present embodiment, a flush toilet 1 with a relatively low silhouette can be provided, in which the discharge valve apparatus 28 is placed at a low height.

What is claimed is:

1. A discharge valve apparatus for flushing a toilet, comprising:

a valve body comprising a valve body main shaft, the valve body opening and closing a discharge port disposed on the bottom surface of a flush water tank;

a small-flush float mechanism comprising a small-flush cam lock portion formed to be engageable with the valve body main shaft, and a small-flush float which is lowered with a falling water level when a predetermined amount of small-flush water is discharged, the small-flush float mechanism being configured such that engagement of the small-flush cam lock portion with the valve body main shaft is released when the small-flush float is lowered;

a large-flush float mechanism comprising a large-flush cam lock portion formed to be engageable with the valve body main shaft, and a large-flush float which is lowered with a falling water level when a predetermined amount of large-flush water is discharged, the large-flush float mechanism being configured such that engagement of the large-flush cam lock portion with the valve body main shaft is released when the large-flush float is lowered;

and a casing portion for housing the valve body, the small-flush float, and the large-flush float, the small-flush float and the large-flush float being disposed above the valve body;

wherein the valve body main shaft of the valve body comprises a single shared projecting portion which engages with the large-flush cam lock portion when the valve body main shaft is pulled up by a pull-up height set for the large-flush mode, and engages with the small-flush cam lock portion when the valve body main shaft is pulled up by a pull-up height set for the small-flush mode.

2. The discharge valve apparatus of claim 1, wherein the small-flush cam lock portion of the small-flush float mechanism is disposed at a position below the large-flush cam lock portion of the large-flush float mechanism.

3. The discharge valve apparatus of claim 1, wherein the small-flush float mechanism further comprises a float hold shaft for holding the small-flush float;

and the small-flush cam lock portion is linked to the bottom end portion of the float hold shaft.

4. The discharge valve apparatus of claim 3, wherein the casing portion further comprises a hold portion extended laterally from the side portion of the casing and slidably holding the float hold shaft.

5. The discharge valve apparatus of claim 4, wherein the float hold shaft of the small-flush float mechanism forms a screw portion on the outer perimeter surface of the float hold shaft, the screw portion being threadedly connected to the small-flush float.

6. A flush water tank apparatus comprising the discharge valve apparatus of claim 1.

7. A flush toilet comprising the flush water tank apparatus of claim 6.

* * * * *